US012629750B2

(12) United States Patent
Bishop et al.

(10) Patent No.: US 12,629,750 B2
(45) Date of Patent: May 19, 2026

(54) PRECIPITATION HARDENING POWDER METAL COMPOSITION

(71) Applicant: GKN Sinter Metals, LLC, Auburn Hills, MI (US)

(72) Inventors: Donald Paul Bishop, Stillwater Lake (CA); Margaret F. Wilson, Halifax (CA); Ian W. Donaldson, Madison, NH (US); Richard L. Hexemer, Jr., Granite Falls, NC (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 67 days.

(21) Appl. No.: 18/715,660

(22) PCT Filed: Jul. 29, 2022

(86) PCT No.: PCT/US2022/038820
§ 371 (c)(1),
(2) Date: May 31, 2024

(87) PCT Pub. No.: WO2023/101727
PCT Pub. Date: Jun. 8, 2023

(65) Prior Publication Data

US 2025/0170641 A1 May 29, 2025

Related U.S. Application Data

(60) Provisional application No. 63/285,871, filed on Dec. 3, 2021, provisional application No. 63/285,804, filed on Dec. 3, 2021.

(51) Int. Cl.
*B22F 1/142* (2022.01)
*B22F 3/12* (2006.01)
(Continued)

(52) U.S. Cl.
CPC ..... *B22F 3/12* (2013.01); *B22F 1/142* (2022.01); *B22F 3/17* (2013.01); *B22F 3/24* (2013.01);
(Continued)

(58) Field of Classification Search
None
See application file for complete search history.

(56) References Cited

U.S. PATENT DOCUMENTS

2011/0265757 A1 11/2011 Bishop et al.
2017/0028469 A1 2/2017 Bishop et al.

FOREIGN PATENT DOCUMENTS

CN 106756319 A * 5/2017 ..... C22C 21/02
CN 107695340 A 2/2018
(Continued)

OTHER PUBLICATIONS

Japanese Patent Office, Notice of Reasons for Refusal, Application No. 2024-533004, Aug. 26, 2025, 5 pages.
(Continued)

*Primary Examiner* — Xiaobei Wang
(74) *Attorney, Agent, or Firm* — Quarles & Brady LLP

(57) ABSTRACT

A powder metal composition providing a powder metal material to be compacted, sintered, and heat treated to be comparable to wrought 6013 aluminum alloy. The powder metal composition includes an aluminum base powder metal, an aluminum-silicon powder metal, an aluminum-copper powder metal, and an elemental magnesium powder metal. A weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to
(Continued)

1.2 wt % of the powder metal composition. This powder metal is compactable to form a green compact which is further sinterable and heat treatable to provide a powder metal composition comparable to wrought 6013 aluminum alloy.

21 Claims, 20 Drawing Sheets

(51) Int. Cl.
*B22F 3/17* (2006.01)
*B22F 3/24* (2006.01)
*C22F 1/047* (2006.01)

(52) U.S. Cl.
CPC ..... *C22F 1/047* (2013.01); *B22F 2003/248* (2013.01); *B22F 2301/052* (2013.01); *B22F 2301/058* (2013.01); *B22F 2301/10* (2013.01); *B22F 2302/105* (2013.01); *B22F 2302/20* (2013.01); *B22F 2302/45* (2013.01)

(56) References Cited

FOREIGN PATENT DOCUMENTS

| | | | |
|---|---|---|---|
| CN | 108070752 | A | 5/2018 |
| EP | 0436952 | A1 | 7/1991 |
| JP | H03107433 | A | 5/1991 |
| JP | H04131304 | A | 5/1992 |
| JP | H083601 | A | 1/1996 |
| JP | 2005126816 | A | 5/2005 |
| JP | 2017514994 | A | 6/2017 |
| WO | 2022165044 | A2 | 8/2022 |

OTHER PUBLICATIONS

Japanese Patent Office, Notice of Reasons for Refusal, Application No. 2024-533006, Sep. 2, 2025, 6 pages.

PCT International Search Report and Written Opinion, PCT/US2022/038820, Nov. 14, 2022, 14 pages.

Meyer et al., Laserstrahlschweißen der Al-Mg-Si-Cu-Legierung 6013, HTM Journal of Heat Treatment and Materials, 1997, 52(5):291-297.

Sweet et al., Powder Metallurgical Processing of a 2xxx Series Aluminum Powder Metallurgy Metal Alloy Reinforced with AlN Particulate Additions, Materials Science & Engineering A, 2019, 755:10-17.

Wilson, Sinter-Swage Processing of an Al-Si-Mg-Cu Powder Metallurgy Alloy, Retrieved from https://dalspace.library.dal.ca/bitstream/handle/10222/80737/MargaretWilson2021.pdf?sequence=2, Copyright Margaret Wilson 2021, pp. 45-64.

* cited by examiner 6013 w/Al-0.6Mn + 0.5%Sn
As-Sintered 6013 w/Al-0.6Mn + 0.5%Sn
As-Swaged 6013 w/Al-0.6Mn + 0%Sn 6013 w/Al-0.6Mn + 0.5%Sn 6013 w/Pure Al + 0%Sn 6013 w/Pure Al + 0.5%Sn 6013 w/Al-0.6Mn + 0%Sn 6013 w/Al-0.6Mn + 0.5%Sn

PRECIPITATION HARDENING POWDER METAL COMPOSITION

CROSS-REFERENCE TO RELATED APPLICATION

This application represents the U.S. national stage entry of International Application No. PCT/US2022/038820 filed Jul. 29, 2022, which claims the benefit of the filing date of U.S. Provisional Patent Application No. 63/285,804 entitled "Precipitation Hardening Powder Metal Composition" filed on Dec. 3, 2021 and claims the benefit of the filing date of U.S. Provisional Patent Application No. 63/285,871 entitled "Hot Deformation Processing of a Precipitation Hardening Powder Metal Alloy" filed on Dec. 3, 2021, which are hereby incorporated by reference for all purposes as if set forth in their entirety herein.

STATEMENT OF FEDERALLY SPONSORED RESEARCH OR DEVELOPMENT

Not applicable.

FIELD OF THE INVENTION

This disclosure relates to powder metallurgy formulations and sintered components made therefrom. In particular, this disclosure relates to a powder metal composition for a replacement wrought 6013 aluminum alloy.

BACKGROUND

The 6013 aluminum alloy is a precipitation-hardened aluminum alloy containing magnesium (Mg) and silicon (Si) as the main alloying elements. It exhibits good mechanical properties and weldability along with excellent corrosion resistance. Due to this combination of properties, it has become one of the most widely used aluminum alloys. Aluminum 6013 has a wide range of applications including aerospace components, automotive components, valve components, machine parts, munitions, braking systems, hydraulic applications, and so forth. As used herein, the 6013 aluminum alloy composition should be understood to mean, by weight percent, between 94.8% to 97.8% aluminum, 0.8% to 1.2% magnesium, 0.60% to 1.0% silicon, 0.60% to 1.1% copper, 0.20% to 0.80% manganese, less than or equal to 0.50% iron, less than or equal to 0.25% zinc, less than or equal to 0.10% chromium, and less than or equal to 0.10% titanium with the remainder being no more than 0.050% each in an amount of no more than 0.15% total.

In the 6013 alloy, the magnesium and silicon are the basis for the heat treatment of this system and form the $Mg_2Si$ intermetallic phase that improves the mechanical properties. Copper is also responsible for improving mechanical properties. Iron exists as an impurity and forms different intermetallic phases that affect corrosion and mechanical properties.

There are a large number of ways of forming metal components and powder metal or "PM" processes represent one class of production techniques for forming metal components. Powder metallurgy generally involves producing or obtaining a powder metal material, compacting this powder metal material in a tool and die set to form a green compact or preform having a geometry approximating the desired end product, and then sintering the green compact to cause the powder metal particles to diffuse into one another and to densify into a much more mechanically strong body. Powder metallurgy is well-suited for producing parts in large volumes and can offer the benefits of low scrap costs and the ability to produce components which may not require subsequent machining after being formed.

Although this is just general overview of the powder metal production processes, what can be appreciated from this description is that much of the powder metal processes can typically happen in the solid state or with only a limited amount of liquid being formed during the sintering process. However, this also highlights some of the challenges in using powder metal processes as, with sintering being a diffusion-dependent process, the resultant microstructure and porosity is a function of the powder formulation and processing conditions. Thus, attempting to convert a wrought or cast alloy to a powder metal formulation can present challenges in creating both a comparable microstructure and providing comparable mechanical properties.

SUMMARY

At present, there is no powder metal equivalent of the "wrought" 6013 aluminum alloy that is cast. From the background section above, it will be appreciated that such many wrought alloys cannot merely be fabricated by combining various elemental powders together because the powder metal processes are diffusion-dependent and the resulting morphology may not be comparable to, for example, a cast part having an otherwise similar chemical composition. Still further, because powder metal parts are various particles sintered together, there is typically some amount of porosity after conventional sintering processes and that porosity can adversely impact material properties in comparison to a fully dense part.

Disclosed herein is a powder metal composition comparable to a wrought 6013 aluminum alloy. This powder metal 6013 aluminum alloy adds another potential alloy to the toolbox of materials available for new applications and may open the door to the production of components from powder metal that have been previously limited to wrought alloy production. Such alloy may be particularly helpful in the fabrication of components for electric vehicles. Still further, the 6013 powder metal composition and components made therefrom can include the addition of metal-matrix composite (MMC) additions to improve wear resistance and strength.

According to one aspect, a powder metal composition provides a powder metal material to be compacted, sintered, and heat treated to be comparable to wrought 6013 aluminum alloy. The powder metal composition includes an aluminum base powder metal (defined herein as powder metal which include either pure aluminum without any effective alloying elements or in which the alloying elements are no more than 2 wt % of the aluminum base powder metal), an aluminum-silicon powder metal, an aluminum-copper powder metal, and an elemental magnesium powder metal. A weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to 1.2 wt % of the powder metal composition.

In some forms, the aluminum base powder metal may be pure aluminum with no effective alloying elements prealloyed in the aluminum base powder metal. In this form, the powder metal composition may further include an elemental tin powder metal and a weight percent of tin in the powder metal composition may be in a range of between 0.2 wt % and 1.0 wt % of the powder metal composition. It is contemplated that, in some forms, the weight percent of silicon in the powder metal composition may be more narrowly be in a range of 0.7 to 0.9 wt % of the powder metal composition, the weight percent of copper in the powder metal composition may be more narrowly in a range of 0.8 to 1.0 wt % of the powder metal composition, the weight percent of magnesium in the powder metal composition may be more narrowly in a range of 0.9 to 1.1 wt % of the powder metal composition, and the weight percent of tin in the powder metal composition may be more narrowly in a range of 0.4 to 0.6 wt % of the powder metal composition with a balance of the powder metal composition being aluminum with only non-effective trace additions of any other alloying elements. Still more specifically, in one particular form, in the powder metal composition the weight percent of silicon in the powder metal composition may be 0.8 wt % of the powder metal composition, the weight percent of copper in the powder metal composition may be 0.9 wt % of the powder metal composition, the weight percent of magnesium in the powder metal composition may be 1.0 wt % of the powder metal composition, and the weight percent of tin in the powder metal composition may be 0.5 wt % of the powder metal composition.

In some forms, the aluminum base powder metal may be an aluminum powder metal pre-alloyed with manganese to provide a weight percent of manganese in the powder metal composition is in a range of 0.2 to 1.2 wt % of the powder metal composition. In this form, the weight percent of manganese in the powder metal composition may be more narrowly in a range of 0.4 to 0.6 wt % of the powder metal composition. Still more specifically, in one particular form, in the powder metal composition, the weight percent of manganese in the powder metal composition may be 0.5 wt % of the powder metal composition. In some cases, where the aluminum base powder metal is a pre-alloyed aluminum powder metal alloyed with manganese, the powder metal composition may further include an elemental tin powder and a weight percent of tin in the powder metal composition may in a range of 0.2 wt % to 1.0 wt % of the powder metal composition and might be targeted around 0.5 wt %.

In various forms and regardless of the aluminum base powder metal and whether it is pure or pre-alloyed, the powder metal composition may further include an elemental tin powder and a weight percent of tin in the powder metal composition may be in a range of between 0.2 to 1.0 wt % of the powder metal composition and might be targeted around 0.5 wt %.

In some forms, the aluminum-silicon powder metal may be an Al-12Si master alloy powder metal (approximately 88 wt % aluminum and 12 wt % silicon) and the aluminum-copper powder metal may be an Al-50Cu master alloy powder metal (approximately 50 wt % aluminum and 50 wt % copper).

In some forms, the powder metal composition may further include a lubricant and the weight percentages of the alloying elements are exclusive of the weight of the lubricant. This may be the case, as the lubricant is configured to be burned off during sintering of the powder metal composition.

In some forms, the powder metal composition may further include a ceramic powder addition to provide a metal matrix composite upon sintering. The ceramic powder addition can be less than 15 volume percent of the powder metal and the weight of the ceramic powder is not taken into account in calculating the weight percentages of the alloying elements. The ceramic powder addition may be an aluminum nitride having a specific surface area of less than or equal to 2.0 $m^2/g$ and has a particle size distribution of D 10% of between 0.4 and 1.4 μm, D 50% of between 6 and 10 μm, and D 90% of between 17 and 35 μm. The aluminum nitride may have a specific surface area of between 1.8 and 3.8 $m^2/g$ and has a particle size distribution of D 10% of between 0.2 and 0.6 μm, D 50% of between 1 and 3 μm, and D 90% of between 5 and 10 μm. The aluminum nitride (AlN) may have a hexagonal crystal structure and may be single phase. In some forms, the ceramic addition could be silicon carbide (SiC). Beta silicon carbide is a synthetic SiC with a cubic structure, like diamond, which gives it superior physical and chemical properties. The Mohs hardness of β-SiC is second only to diamond's 10 on Mohs scale. In addition to high hardness, β-SiC has good chemical stability, high thermal conductivity, and a low thermal coefficient of thermal expansion. In one embodiment, the ceramic powder addition in the powder metal composition would be 2 vol % β-SiC relative to the total volume of the powder metal composition with an upper limit of 10 vol %.

In some forms, the powder metal composition may have a flow rate of between 2.0 and 3.0 g/s. This flow rate may be indicative of the powder morphology in a way that other parameters of the powder metals are not.

According to another aspect, a green compact may be formed (e.g., by compacting) from any of the powder metal compositions described above and herein. Likewise, a sintered powder metal component may be formed (e.g., by sintering) from such a green compact. A sintered density of the sintered powder metal component may exceed 95% of theoretical density. Still further, the sintered powder metal component, as sintered and subjected to a T6 treatment of solutionizing, water quenching, aging, and air cooling, may have a Young's modulus of between 61 GPa and 77 GPa, a Yield Strength of between 324 MPa and 344 MPa, and an ultimate tensile strength (UTS) between 324 MPa and 379 MPa.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

BRIEF DESCRIPTION OF THE FIGURES

FIGS. 1A and 1B are SEM images of the base aluminum powder utilized in the powder metal 6013 variants with FIG. 1A being an image of pre-alloyed Al-0.6Mn powder metal and FIG. 1B being an image of pure aluminum powder. FIGS. 1C-1F are SEM images of the alloying additions including elemental Mg powder metal in FIG. 1C, an Al-12Si master alloy powder metal in FIG. 1D, an elemental tin powder in FIG. 1E, and an Al-50Cu master alloy powder metal in FIG. 1F.

FIGS. 3A and 3B are SEM images of sintered and swaged microstructures of powder metal 6013 with Al-0.6Mn+0.5 wt % Sn powder metal in (i.e., PM6013-Mn—Sn) the as-sintered condition in FIG. 3A and in the as-swaged condition in FIG. 3B. FIGS. 3C-3F are SEM images of sintered and swaged microstructures in the as-swaged condition for powder metal 6013 with Al-0.6Mn+0 wt % Sn powder metal in FIG. 3C (i.e., PM6013-Mn), for powder metal 6013 with Al-0.6Mn+0.5 wt % Sn powder metal in FIG. 3D (i.e., PM6013-Mn—Sn), for powder metal 6013 with pure Al+0 wt % Sn powder metal (i.e., PM6013) in FIG. 3E, and for powder metal 6013 with pure Al+0.5 wt % Sn powder metal (i.e., PM6013-Sn) in FIG. 3F.

FIG. 4A-4D are differential scanning calorimetry (DSC) heating traces acquired from the 6013 powder metal variants in which FIG. 4A shows the DSC heating trace of PM6013-Mn, FIG. 4B shows the DSC heating trace of PM6013-Mn—Sn, FIG. 4C shows the DSC heating trace of PM6013, and FIG. 4D shows the DSC heating trace of PM6013-Sn.

in FIG. 5A, at 560° C. in FIG. 5B, and at 580° C. in FIG. 5C prior to a water quench and aging at 190° C.

FIG. 7A is the T8 aging data for PM6013-Mn, FIG. 7B is the T8 aging data for PM6013-Mn—Sn, FIG. 7C is the T8 aging data for PM6013, and FIG. 7D is the T8 aging data for PM6013-Sn.

FIG. 9A shows the Young's modulus values ("E values"), FIG. 9B shows the elongation at break values, FIG. 9C shows the 0.2% offset yield values, and FIG. 9D shows the ultimate tensile strength (UTS).

DETAILED DESCRIPTION

Figure 1A:
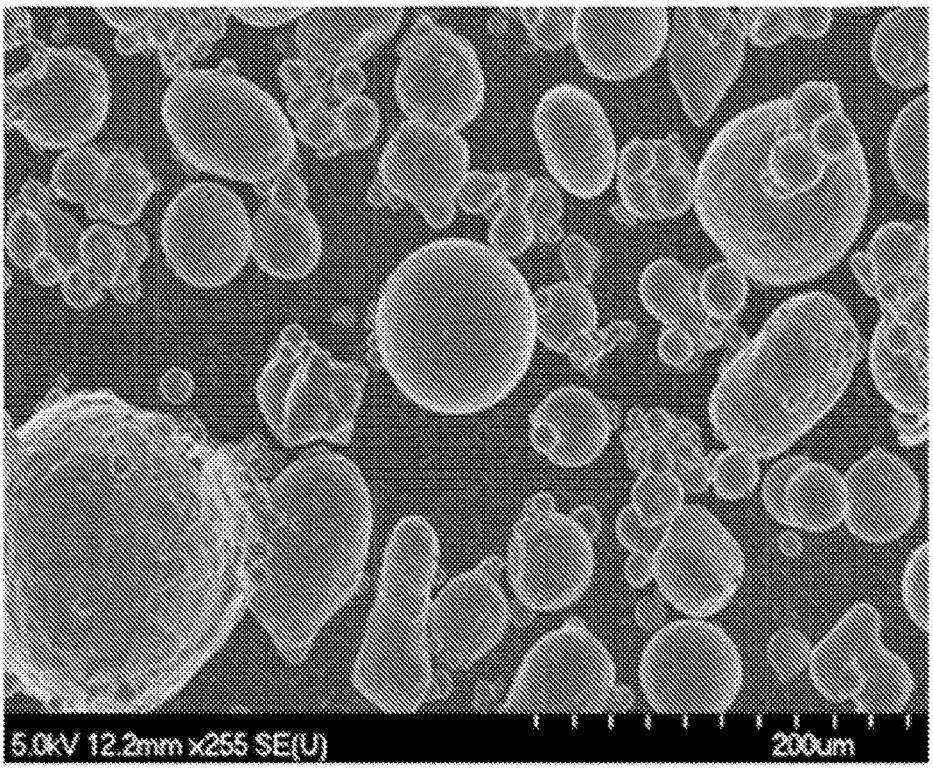
FIGS. 1A-1F are scanning electron microscope (SEM) images of various powders used in preparation of the 6013 powder metal variants.

A powder metal composition is disclosed here which is comparable to those of a 6013 aluminum alloy. Below, exemplary powder metal compositions are disclosed and some variations thereto.

Four alloys were explored as powder metal counterparts to wrought 6013 aluminum alloy, all containing identical concentrations of magnesium, silicon, and copper. Variants of the alloy were prepared with and without pre-alloyed manganese and admixed tin. While manganese is utilized in wrought 6031, and was found in two of the four variants, pre-alloying of aluminum often increases the yield strength of a powder metal and can complicate die compaction behavior and so two variants were also prepared that lacked manganese. For each of the manganese containing and non-manganese containing formulations, tin additions were also investigated with one formulation including no tin and the other including a trace addition 0.5 wt % of tin. Tin can help catalyze the densification response of powder metal alloys and investigated for this reason.

These four variant compositions are designated as PM6013-Mn, PM6013-Mn—Sn, PM6013, and PM6013-Sn, the composition of each system is shown below in Table 1 with the percentages all referring to weight percentages of the total powder metal weight (excluding lubricant).

TABLE 1

| Powder Metal Alloy | Chemistry | Al | Mn | Si | Mg | Sn | Cu |
|---|---|---|---|---|---|---|---|
| PM6013-Mn | Target | Bal. | 0.5 | 0.8 | 1.0 | 0.0 | 0.9 |
| | Measured | Bal. | 0.52 | 0.83 | 1.1 | 0.05 | 0.93 |
| PM6013-Mn-Sn | Target | Bal. | 0.5 | 0.8 | 1.0 | 0.5 | 0.9 |
| | Measured | Bal. | 0.53 | 0.85 | 1.1 | 0.49 | 0.89 |
| PM6013 | Target | Bal. | 0.0 | 0.80 | 1.0 | 0.0 | 0.9 |
| | Measured | Bal. | 0.002 | 0.85 | 1.2 | 0.002 | 1.0 |
| PM6013-Sn | Target | Bal. | 0.0 | 0.8 | 1.0 | 0.5 | 0.9 |
| | Measured | Bal. | 0.001 | 0.84 | 1.1 | 0.48 | 0.95 |

The PM6013-Mn and PM6013-Mn—Sn compositions were formed from a blend of Al-0.6Mn powder metal (0.6 wt % manganese pre-alloyed with aluminum with the balance of the powder Al-0.6Mn powder—approximately 99.4 wt %—being aluminum) [$D_{50}$=103 μm], an Al-12Si powder metal (a master alloy powder of 12 wt % Si with the remainder being aluminum) [$D_{50}$=33 μm], Al-50Cu (a master alloy powder of 50 wt % Cu with the remainder being aluminum) [$D_{50}$=31 μm] and separate admixed elemental powder metals of magnesium [$D_{50}$=31 μm] and, in the case of the PM6013-Mn—Sn formulation, tin [$D_{50}$=4 μm]. The PM6013 and PM6013-Sn compositions were made from pure aluminum powder metal [$D_{50}$=116 μm] mixed with Al-12Si powder metal [$D_{50}$=33 μm], Al-50Cu powder metal [$D_{50}$=31 μm], and separate admixed elemental powder metal additions of magnesium [$D_{50}$=31 μm], and, in the case of the PM6013-Sn formulation, tin [$D_{50}$=4 μm]. All powders were produced by Kymera International (Raleigh, NC), with the exception of the elemental magnesium powder, which was produced through inert gas atomization by Tangshan Weihao Magnesium Powder Company Ltd. (Qian'an City, Hebei Province, CN). In all formulations, the various powder metal constituents were combined at ratios and proportions to achieve the target composition and, while the exact powder amounts are not provided herein, it is trivial given the powder metal "ingredient" list for each formulation or variant to work backwards to find the exact powder metal proportions combined in each case.

Figure 1B:
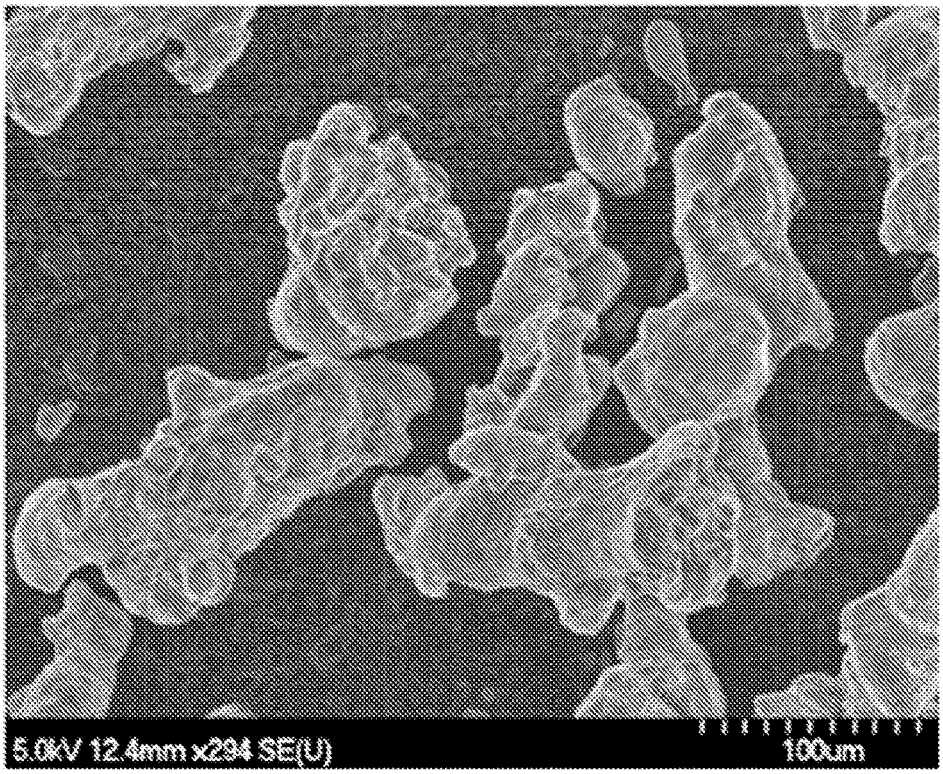
Figure 1C:
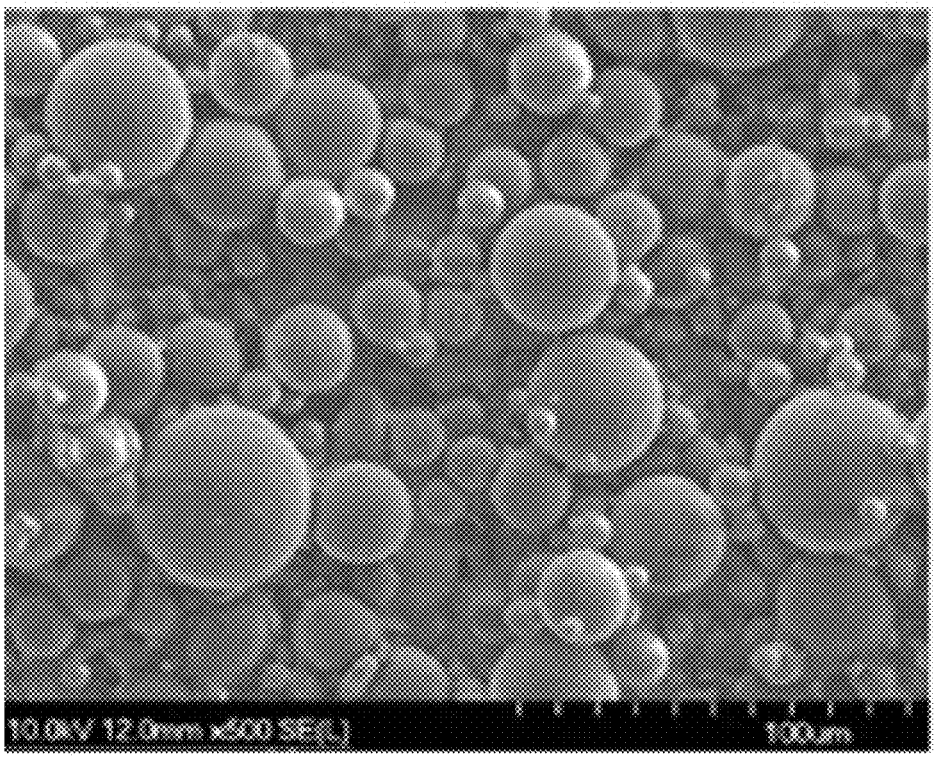
Figure 1D:
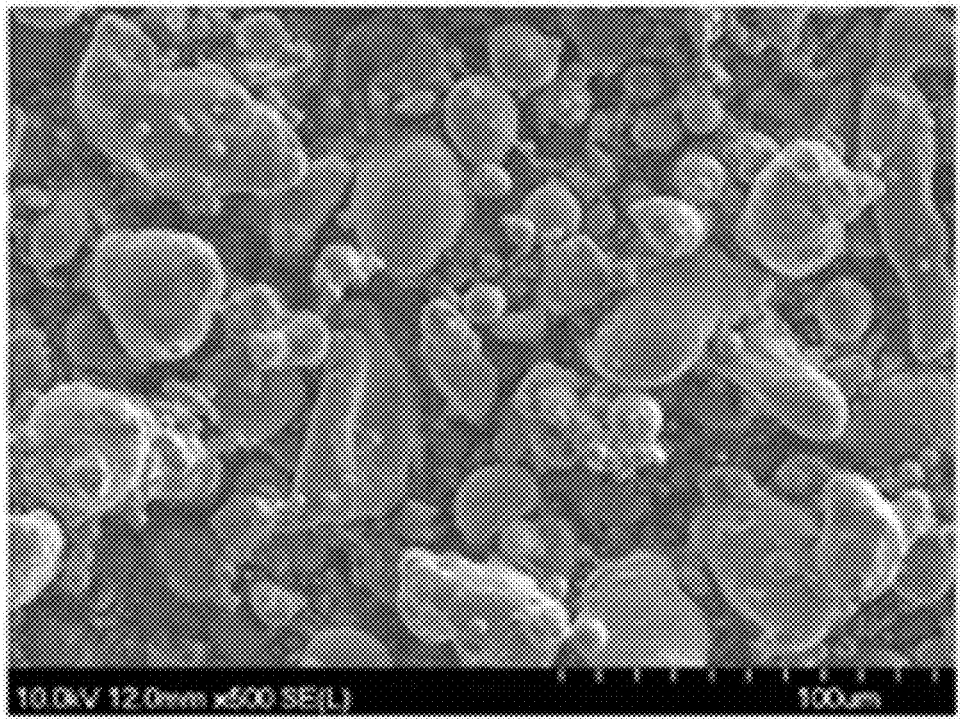
Figure 1E:
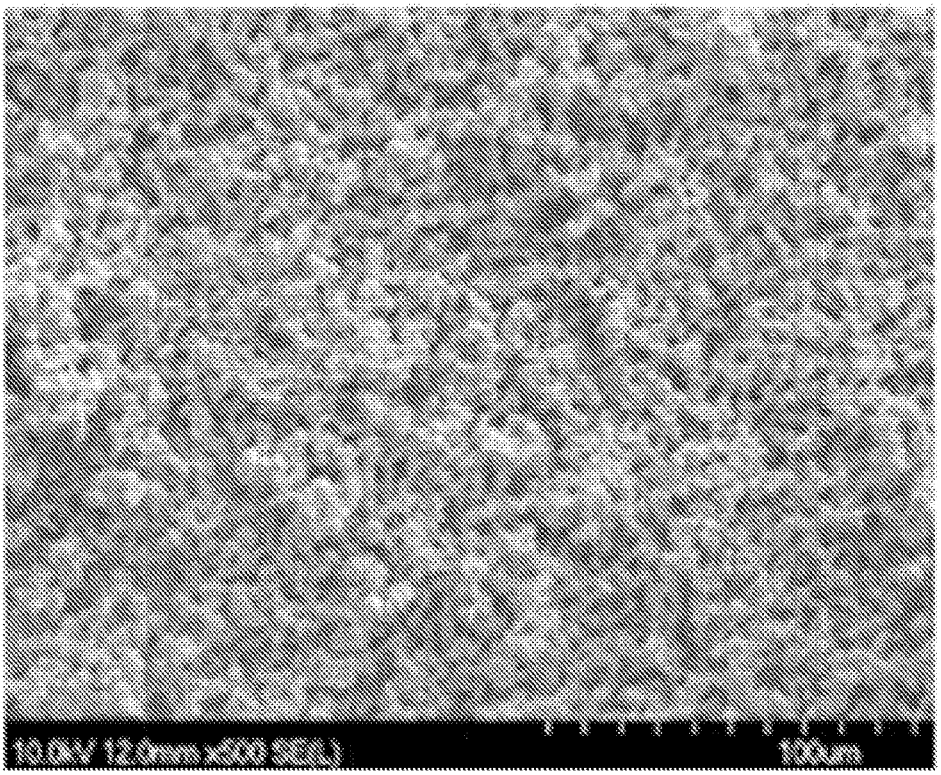
Figure 1F:
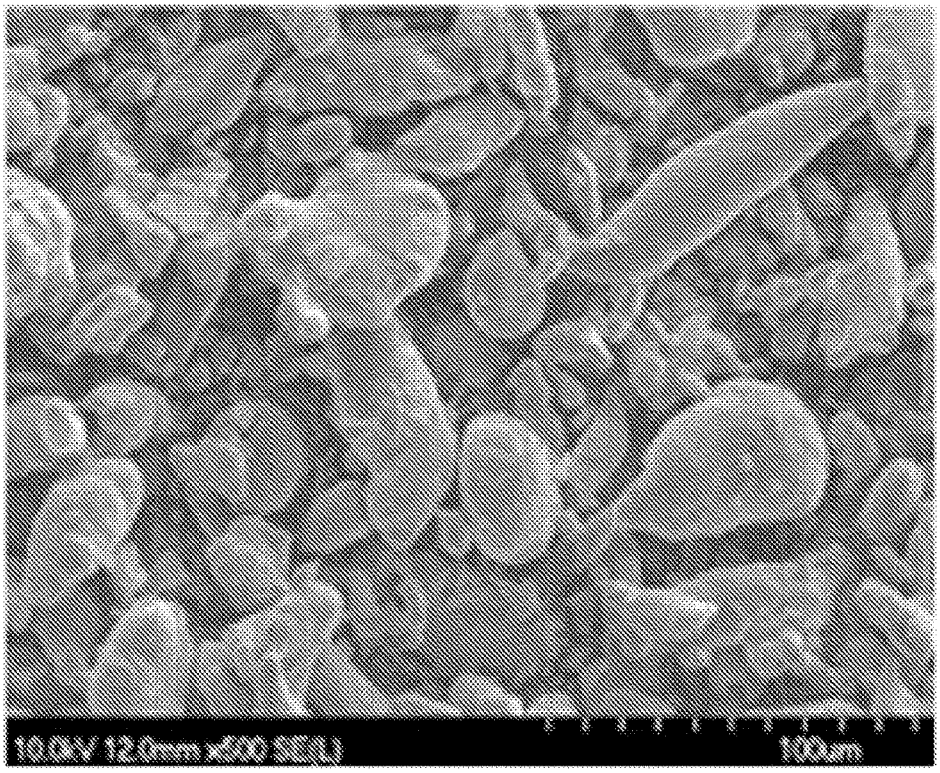

With reference to FIGS. 1A through 1F, the various powder metals are shown under scanning electron microscope that were blended to create these alloy compositions. FIG. 1A shows powder metal Al-0.6Mn, FIG. 1B shows pure aluminum, FIG. 1C shows elemental magnesium, FIG. 1D shows Al-12Si, FIG. 1E shows elemental Sn, and FIG. 1F shows Al-50Cu (50 wt % Cu with the remainder being aluminum.

For each of the powder metal compositions, 1.5 wt % LicoWax® C (available from Clariant Corporation of Louisville, Kentucky) was added to all blends to allow for ease of compaction. Licowax® C is a lubricant/wax that can help maintain the compacted green part together by keeping the powder particles together and can further help in the removal of the green part during ejection from the tool and die set after compaction. The lubricant is typically burnt off during the sintering process in the preheating zone. According, this 1.5 wt % is based on the powder metal constituents themselves being 100 wt %, and so the alloying percentages above should be understood as being 100% of the powder metal such that the powder metal constituents plus lubricant would actually add to 101.5 wt %.

Additionally, it is contemplated that up to 15% by volume of ceramic additions can be provided to create a metal matrix composite using these 6013 powder metal variants which provides improvements in wear and strength. The ceramic additions are briefly characterized below with aluminum nitride (AlN) being primarily contemplated for addition to the 6013 powder metal variants, although silicon carbide (SiC) is another ceramic addition that is contemplated as being a viable addition.

With respect to the aluminum nitride (AlN) MMC additions, it is contemplated those aluminum nitride additions might be, for example Grade AT aluminum nitride (an agglomerated powder with broader particle size distribution) or Grade BT aluminum nitride (which has a comparably fine particle size and is a deagglomerated powder). Both grades can be used in the disclosed powder metal formulation with the difference being in response to processing and properties.

Both grades AT and BT aluminum nitride have a hexagonal crystal structure and are single phase. For the sake of chemically characterizing these aluminum nitride additions, as mass fractions both Grade AT and BT have a minimum of 32.0% N, a maximum of 0.15% C, and a maximum of 0.05% Fe. However, Grade AT has a maximum of 1.3% O, while Grade BT has a maximum of 1.5% O. The Grade AT has a specific surface area of less than or equal to 2.0 $m^2/g$ while the Grade BT has between 1.8 and 3.8 $m^2/g$. The particle size distribution of the two different grades is illustrated in Table 2 below:

TABLE 2

| Particle Size Distribution | Grade AT | Grade BT |
|---|---|---|
| D 10% | 0.4-1.4 μm | 0.2-0.6 μm |
| D 50% | 6-10 μm | 1-3 μm |
| D 90% | 17-35 μm | 5-10 μm |

Aluminum nitride as the MMC additive can improve the wear, ductility and thermal conductivity properties of the powder metal formulation. In comparison to more traditional MMC additives such as $Al_2O_3$ or SiC, there is minimal tool wear.

In some forms, the ceramic addition could be silicon carbide (SiC). Beta silicon carbide is a synthetic SiC with a cubic structure, like diamond, which gives it superior physical and chemical properties. The Mohs hardness of β-SiC is second only to diamond's 10 on Mohs scale. In addition to high hardness, β-SiC has good chemical stability, high thermal conductivity, and a low thermal coefficient of thermal expansion. In one embodiment, the ceramic powder addition in the powder metal composition would be 2 vol % β-SiC relative to the total volume of the powder metal composition with an upper limit of 10 vol %.

When ceramic additions are employed, the various powder metals, aluminum nitride or other ceramic additions, and lubricant are blended together during powder preparation, preferably in a high intensity mixer, in order to get an even distribution of the various particles, especially the fine particles, throughout the overall powder metal composition blend and to avoid segregation.

The following method was used for alloy preparation and manufacture of powder metal samples investigated.

Initially, the starting powders were blended in the appropriate proportions using a Turbula shaker mixer. Alloying additions were added to the requisite base aluminum powder sequentially with a 30-minute blend time applied between each addition. Apparent density was assessed for each blend using an Arnold Meter, per MPIF Standard 48 and flow rate properties were determined by passing 25 g of each powder blend through a Carney Apparatus to provide the values in Table 3, below.

TABLE 3

| Powder Metal Alloy | Flow Rate (g/s) | Apparent Density ($g/cm^3$) |
|---|---|---|
| PM6013-Mn | 2.2 ± 0.1 | 1.35 ± 0.01 |
| PM6013-Mn—Sn | 2.2 ± 0.2 | 1.41 ± 0.01 |
| PM6013 | 2.9 ± 0.1 | 1.15 ± 0.01 |
| PM6013-Sn | 2.8 ± 0.1 | 1.18 ± 0.01 |

Alloys containing manganese demonstrated higher apparent densities and reduced flow rates relative to those prepared with pure aluminum as the base powder. Both of these responses may be related to the morphology of the base aluminum powder. The powder which was pre-alloyed with manganese (FIG. 1A) had a spherical morphology, while the un-alloyed base powder (FIG. 1B) was irregular in shape. Greater interparticle friction is generated between particles with an irregular morphology. Higher interparticle friction leads to increased separation between particles, which permits fewer particles per unit volume and lowers apparent density. By this principle, the flow rate of PM6013 and PM6013-Sn should be slower than the manganese bearing alloys; it is in fact slightly faster. This may be because the slightly coarser particle size of the pure aluminum base powder allowed the particles to flow more effectively.

The additions of tin had no statistically meaningful effect on flow rate but were found to impart increases in apparent density. Since tin is a relatively heavy element (118.7 g/mol) even minor additions have the capacity to increase the density of a lightweight aluminum alloy to a meaningful extent. For example, as will be shown in Table 4 below, the addition of 0.5 wt. % tin increased the calculated full theoretical densities by 0.09 g/cc (~3.3%). As somewhat similar gains were noted in apparent density values, it was plausible that the results were largely a direct reflection of the heavy element addition.

Once the powder metal was prepared, the samples were die compacted at 220 MPa using an Instron 5594-200HVL test frame and the green compacts had a targeted green density of 2.50 g/cc. Three different samples geometries were fabricated. These were transverse rupture strength (TRS) samples (nominally 31.7 mm×12.7 mm×9.7 mm), Charpy samples (nominally 75 mm×10 mm×10 mm) and larger rectangular samples (nominally 20 mm×92 mm×10 mm). Green density was determined using a "wet" approach, as per MPIF Standard 42. Green strength was determined using a three-point bend methodology, as outlined in MPIF Standard 15. Both were completed using TRS bars.

The compaction response of the 6013 powder metal variants is shown in Table 4 below. For each formulation, a theoretical density for each composition is first provided and then as-measured observed green strengths and green densities (as a percentage of theoretical density) is provided.

TABLE 4

| Powder Metal Alloy | Theoretical Density (g/cc) | Green Strength (MPa) | Green Density (%) |
|---|---|---|---|
| PM6013-Mn | 2.708 | 2.61 ± 0.7 | 93.7 ± 0.2 |
| PM6013-Mn—Sn | 2.717 | 2.70 ± 0.1 | 93.7 ± 0.2 |
| PM6013 | 2.699 | 8.58 ± 0.4 | 92.1 ± 0.2 |
| PM6013-Sn | 2.708 | 8.76 ± 0.8 | 92.2 ± 0.1 |

Although additions of tin had no statistically meaningful effect on these attributes of the green compact, significant differences were noted in the systems that employed pre-alloyed manganese. PM6013 and PM6013-Sn demonstrated an approximately four-fold increase in green strength over their manganese-bearing counterparts. As with flow and apparent density, this difference is believed attributable to the morphology of the base powder particles. Particle shape can be a factor affecting the green strength of a compact and the spherical shape of the base powder pre-alloyed with manganese may have resulted in limited surface contact between particles, and thus an inferior green strength. In contrast, the irregular shape of the un-alloyed aluminum base powder may have manifested many opportunities for mechanical interlocking of particles upon compaction, manifested as higher green strength. Pre-alloying of the base powder with manganese would have exacerbated this effect by strengthening the spherical particles, thereby making them more resilient to the plastic deformation necessary for interlocking.

These samples were then sintered in a three-zone Lindberg tube furnace, under flowing high-purity (99.999%) nitrogen gas. The furnace atmosphere was conditioned prior to heating through multiple applications of an evacuate ($10^{-2}$ torr) and backfill sequence prior to maintaining a static gas flow of 9.4 liters/minute for the duration of the sinter cycle. The thermal profile for the sintering furnace was a 20-minute hold at 420° C. for de-lubrication and a 30-minute hold at 630° C. for sintering when sintering TRS and Charpy samples. Larger rectangular bars were held at 630° C. for 50 minutes to ensure a complete sinter. After the sintering time elapsed, samples were slid into the water-jacketed end of the tube furnace for gas quenching, where they were cooled to ambient temperature under the nitrogen atmosphere. TRS samples were utilized to monitor the general sintering behavior of the alloys. Data on sintered density, dimensional change, and mass change induced by sintering were compiled. To quantify dimensional change, width, length, and overall length (OAL) or thickness measurements were obtained for each sample before and after sintering. Sintered density was assessed using an oil-infiltration Archimedes approach in accordance with MPIF Standard 42. Measurements of density are reported as a percentage of the theoretical full density calculated for the alloy using the approach specified by the Aluminum Association. This data is reported in Table 5, found below.

TABLE 5

| Powder Metal Alloy | Sintered Density (%) | Mass Change (%) | Dimensional Change OAL (%) | Dimensional Change Width (%) | Dimensional Change Length (%) |
|---|---|---|---|---|---|
| PM6013-Mn | 91.1 ± 0.6 | −1.41 ± 0.1 | 1.2 ± 0.4 | 0.1 ± 0.2 | 0.6 ± 0.2 |
| PM6013-Mn—Sn | 90.9 ± 0.1 | −1.48 ± 0.1 | 2.0 ± 0.4 | 0.2 ± 0.1 | 0.6 ± 0.2 |
| PM6013 | 96.3 ± 0.6 | −1.43 ± 0.1 | −4.5 ± 0.2 | −1.8 ± 0.2 | −0.8 ± 0.3 |
| PM6013-Sn | 98.4 ± 0.2 | −1.45 ± 0.1 | −4.2 ± 0.3 | −2.5 ± 0.4 | −1.8 ± 0.1 |

Although all alloys demonstrated mass losses that approximated 1.5 wt %, corresponding to the lubricant boiling off as expected during sintering, there was considerable variation in the sintered density and the warpage that compacts experienced. Alloy variants containing manganese (PM6013-Mn and PM6013-Mn—Sn) did not respond favorably to sintering. Here, sintered densities were inferior to green densities and compacts actually experienced a net swelling in all dimensions. Alloys devoid of manganese (PM6013 and PM6013-Sn) sintered to a much greater extent. The sintered densities of these non-manganese containing material variants were above 96% and had measurably improved relative to those of the starting green compacts. This improvement was consistent with dimensional changes as shrinkage in all directions was noted.

The addition of tin was unable to enhance the sintering response of PM6013-Mn as both swelling and a poor sintered density prevailed with its addition. However, the positive sintering response of PM6013 was further improved by the addition of tin, when one compares PM6013 to PM6013-Sn. This may be related to the behavior of tin during liquid phase sintering. Because tin has a lower melting point than other alloying additions, it typically forms part of the liquid phase that acts to densify the compact. Hence, the addition of tin to PM6013-Mn—Sn and PM6013-Sn might have been expected to have resulted in a slightly higher liquid fraction being present during the liquid phase sintering of these alloys than in PM6013-Mn and PM6013. While high liquid fraction in liquid phase sintering leads to fast densification, the increased densification can cause dimensional control to become more challenging. However, because tin was added in trace quantity, this does not completely explain the observed effect. Aluminum powders invariably react with oxygen to form a thin layer of alumina, $Al_2O_3$, on the surface of the powders. The increased apparent density of the manganese-bearing alloys indicates tighter packing of particles, causing higher amounts of oxide to be present per unit volume than in the alloys that did not contain manganese. It is believed that the inability of tin to wet alumina may have played a role in the differences between the sintering responses of the two tin-bearing alloys.

Somewhat interestingly, the alloys which achieved higher green densities, PM6013-Mn and PM6013-Mn—Sn, also produced a lower sinter density and therefore less densification during sintering. Theoretically, the higher green densities should be measured in the compacts that sintered better, because densification is generally a function of green density. This was not the case here and was unexpected and surprising. An examination of the net change between apparent density and green density of PM6013-Mn and PM6013-Mn—Sn is instructive. PM6013-Mn and PM6013-Mn—Sn demonstrate a net change of 1.2 g/cc and 1.1 g/cc respectively between apparent density and green density. By contrast, PM6013 and PM6013-Sn show slightly higher net changes of 1.3 g/cc and 1.4 g/cc respectively. This indicates that in the compaction of PM6013-Mn and PM6013-Mn—

Sn there was less material movement taking place than in the compaction of the alloys devoid of manganese. This suggests that the particles were not mechanically bonding as effectively, which is also observable in the comparatively lower green strength of these two alloys. Material movement also acts to fracture the oxide film on the powder and provide sites for metal-to-metal mechanical bonding. Because material movement is lessened there are likely fewer sites of metal-to-metal contact established between particles, which may in turn inhibit sintering. Increased interparticle contacts in PM6013 and PM6013-Sn allow these alloys to sinter more effectively.

The disparity in these two sintering responses was particularly evident microstructurally, as seen in FIGS. 2A-2D.

Figure 2A:
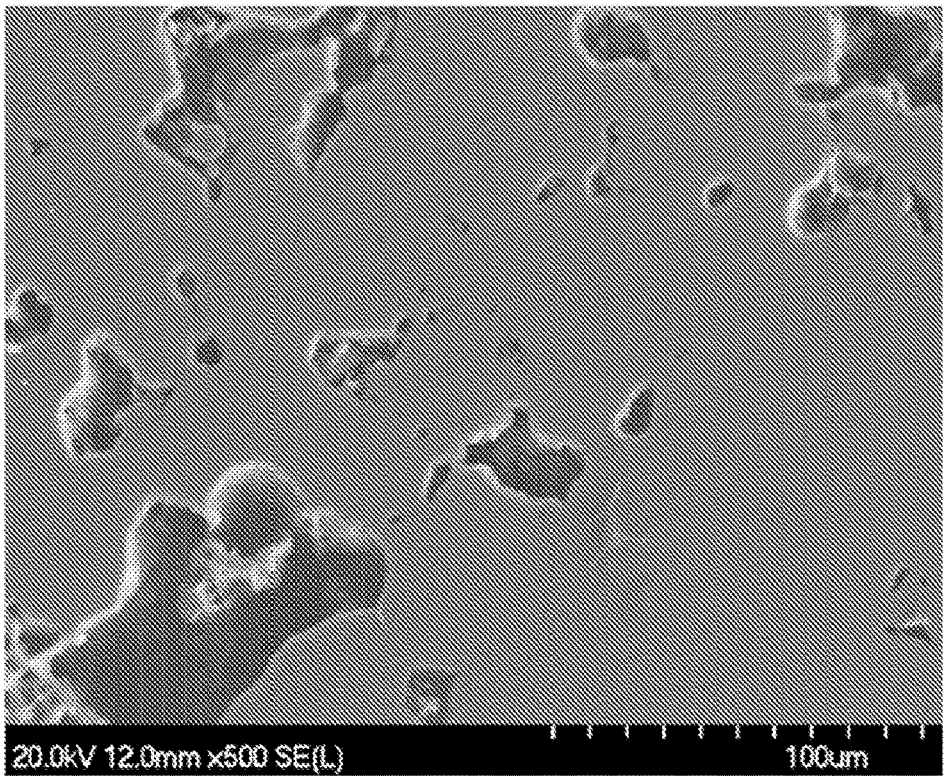
FIGS. 2A-2D are SEM images of the sintered microstructures of PM6013-Mn in FIG. 2A, of PM6013-Mn—Sn in FIG. 2B, of PM6013 in FIG. 2C, and of PM6013-Sn in FIG. 2D. The particular powder metal formulations in both composition and powder blends designated by the names PM6013-Mn, PM6013-Mn—Sn, PM6013, and PM6013-Sn are provided in the detailed description below.
Figure 2B:
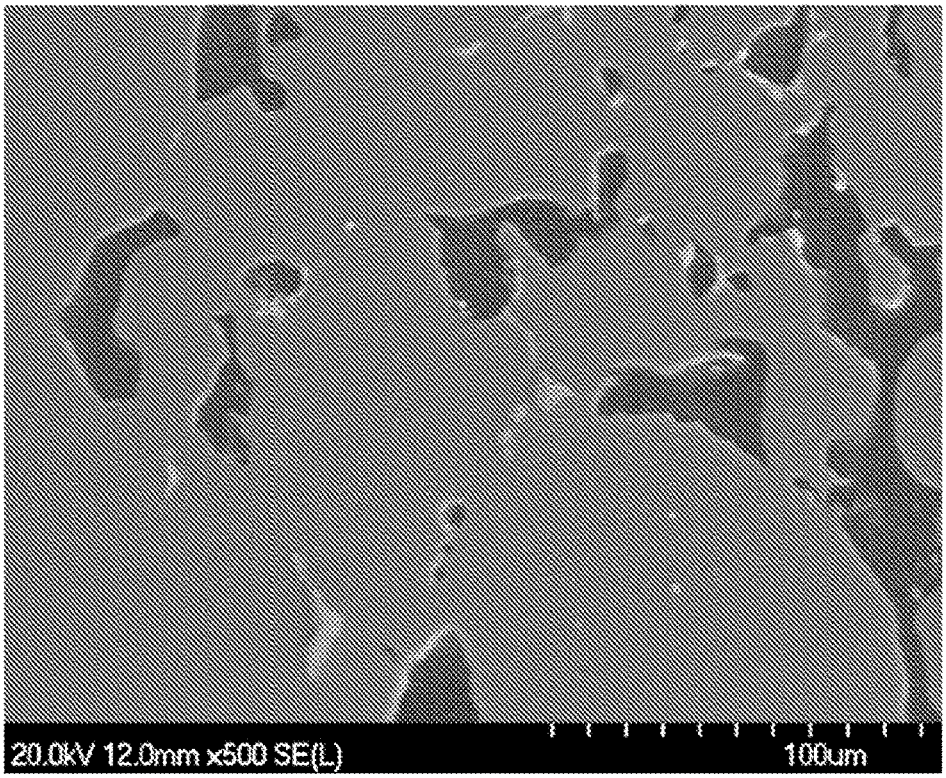
Figure 2C:
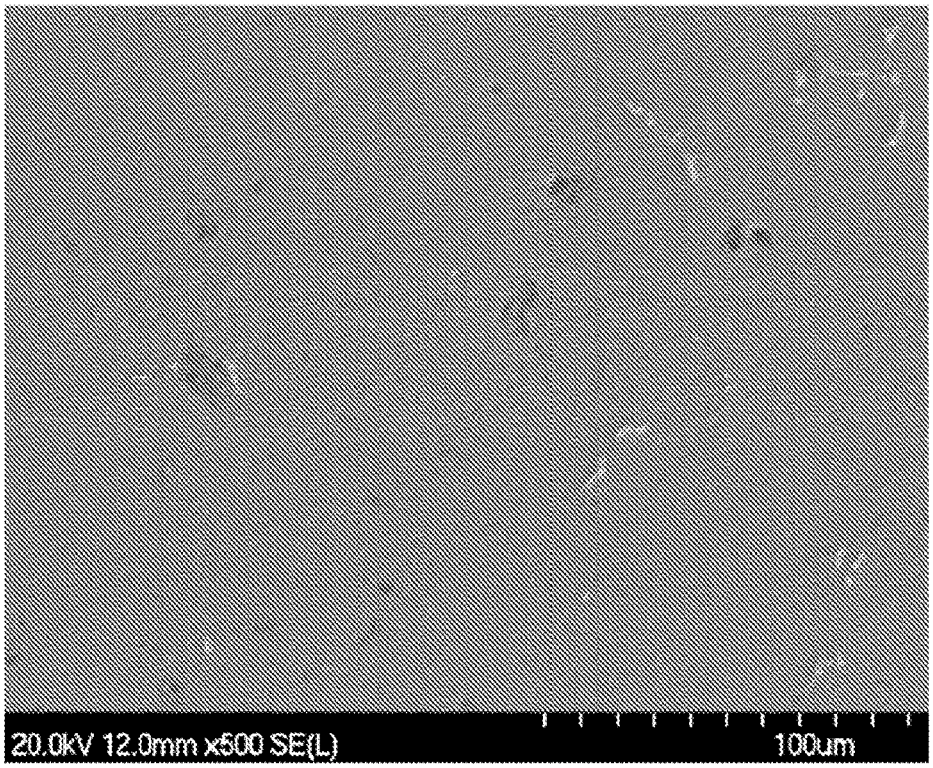
Figure 2D:
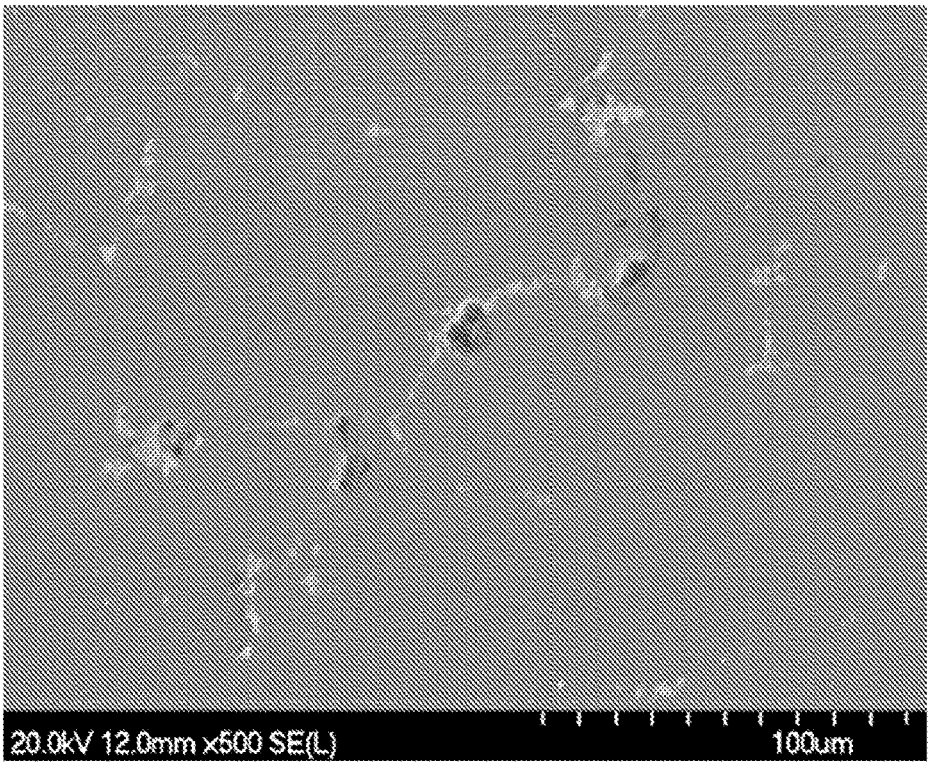

The as-sintered microstructures as observed by scanning electron microscope are shown in FIGS. 2A-2D with FIG. 2A corresponding to PM6013-Mn, FIG. 2B corresponding to PM6013-Mn—Sn, FIG. 2C corresponding to PM6013, and FIG. 2D corresponding to PM6013-Sn. All of these samples are shown in the as-sintered condition without swaging. For microstructural assessments, specimens were hot mounted in conductive epoxy and then polished using a Struers Tegramin semi-automatic polisher. A standard sequence of polishing media was used, including silicon carbide papers, diamond pastes, and colloidal silica. Optical microscopy was carried out using a Zeiss Axiotech upright microscope and a Keyence VK-X1000 laser confocal microscope in optical mode. Electron microscopy was accomplished using a Hitachi S-4700 cold field emission scanning electron microscope (SEM) operated with a 20 kV accelerating voltage and 20 mA beam current. Energy-Dispersive Spectroscopy (EDS) was carried out using an Oxford Instruments X-Max 80 $mm^2$ EDS detector.

Alloys PM6013-Mn (FIG. 2A) and PM6013-Mn—Sn (FIG. 2B) demonstrated low sinter quality. Evidence of the starting powder morphology prevailed, and many irregular and continuous pores (black features) were visible in the microstructures. These factors indicated that only early-stage sinter bonding was achieved.

Conversely, samples produced without manganese including PM6013 (FIG. 2C) and PM6013-Sn (FIG. 2D) sintered to a much higher quality. Raw powder particles were no longer visible and the few pores that remained were rounded and discontinuous.

Sintered bars of each alloy were then processed through hot swaging. Sintered rectangular samples were machined into cylinders (18 mm diameter and 90 mm in length), pre-heated to 485° C. and then hot swaged in a laboratory scale apparatus. This involved a series of passes through successively smaller dies until a final diameter of 12.7 mm was achieved, representing a reduction in area of approximately 50%, for an extrusion ratio of 2:1. Samples were re-heated at 485° C. for 5 minutes between each pass.

Figure 3A:
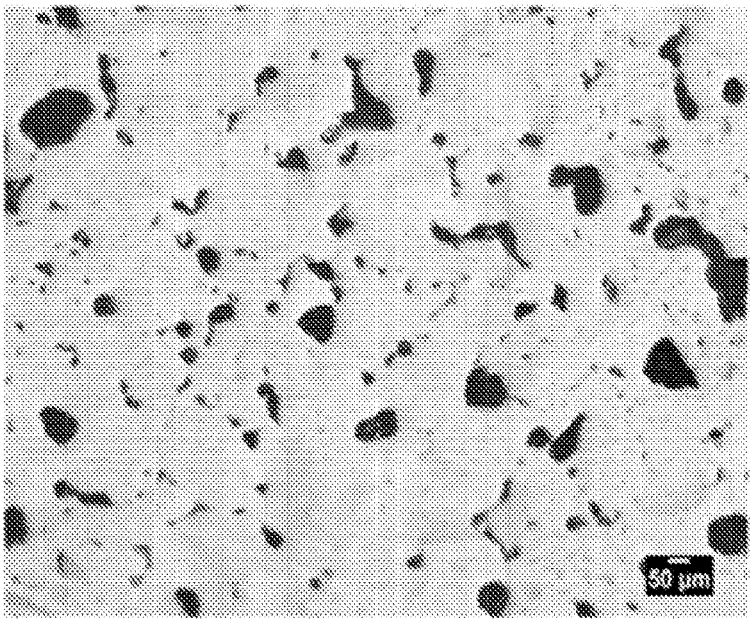
FIGS. 3A-3F are SEM images of sintered and swaged microstructures.
Figure 3B:
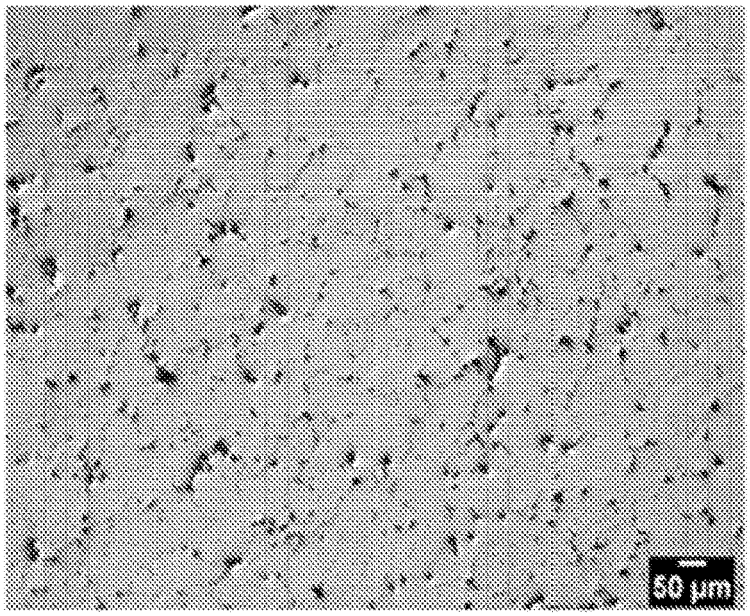
Figure 3C:
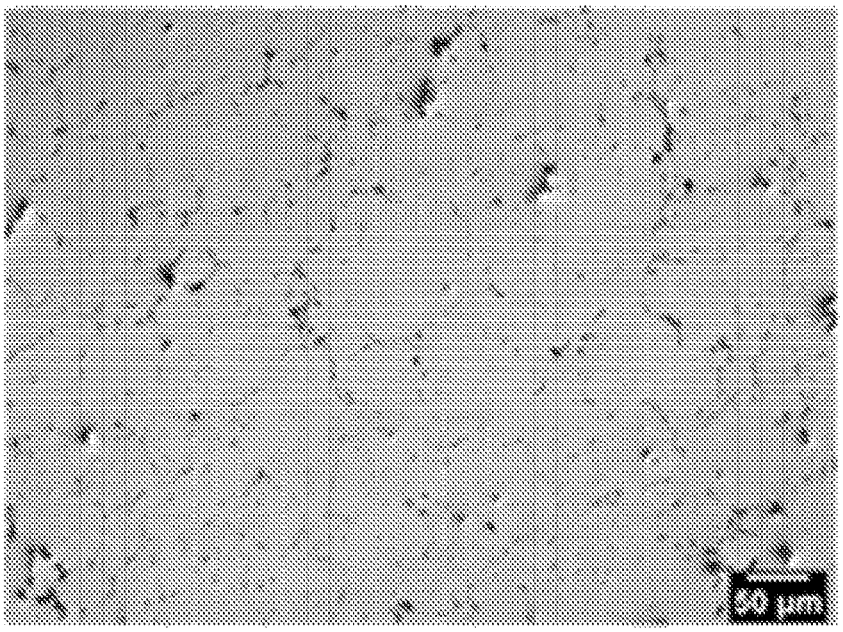
Figure 3D:
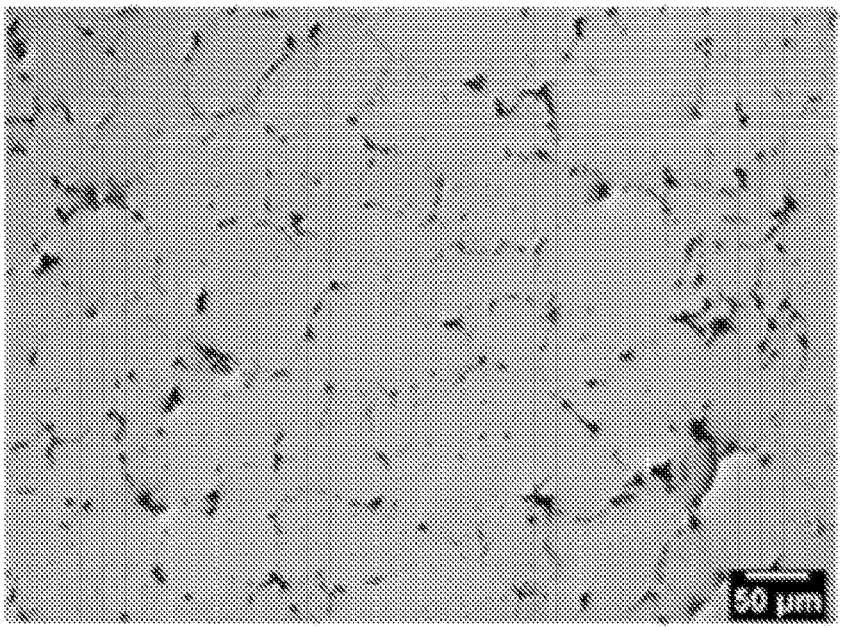
Figure 3E:
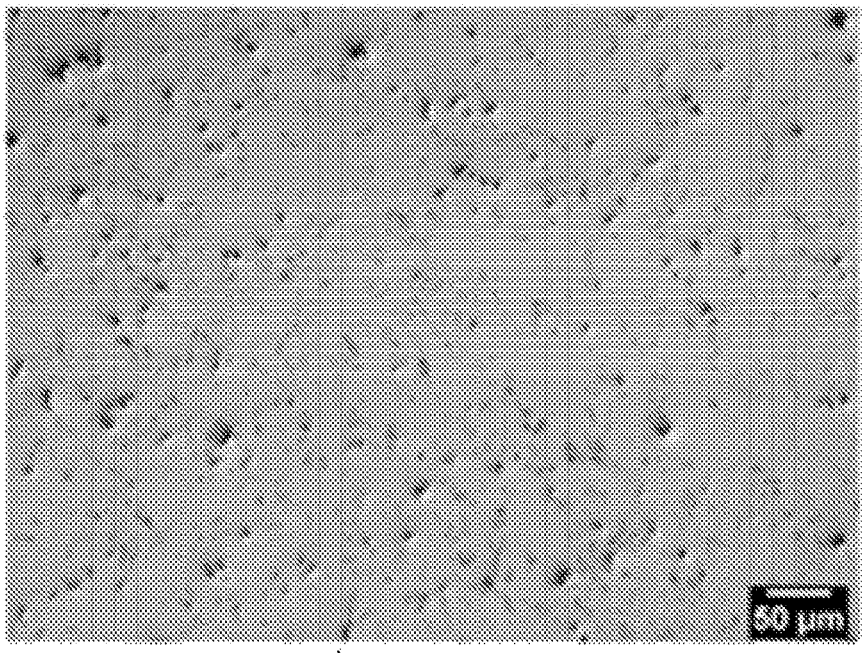
Figure 3F:
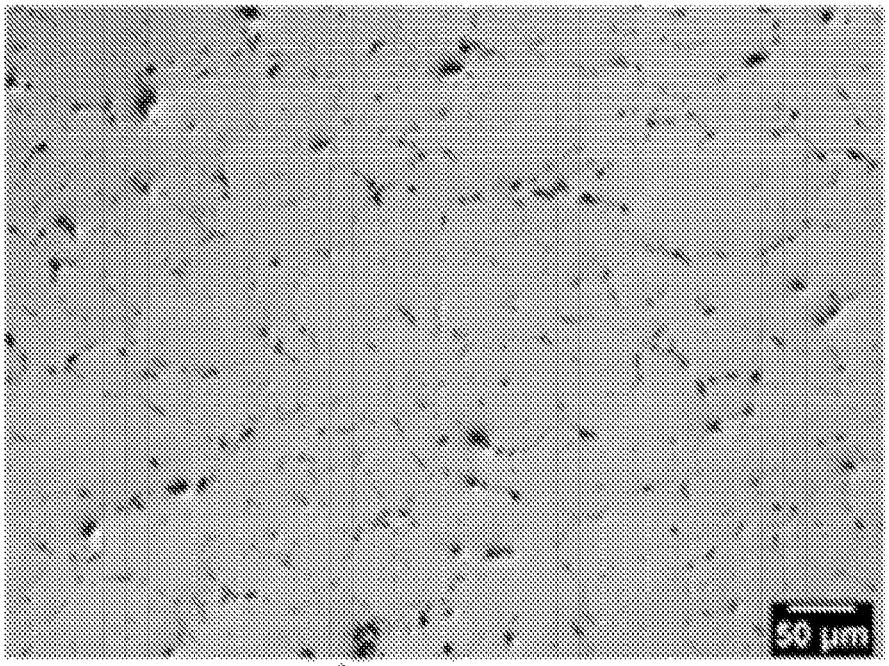

Macroscopically, all alloys responded well, as no visible defects were evident in the finished products as swaged, considering FIGS. 3B-3F which show various as-swaged microstructures. Microstructurally, the effect of swaging was immediately apparent in the manganese-bearing alloys when comparing the pre-swaged (e.g., FIGS. 2A, 2B, and 3A) and post-swaged (e.g., FIG. 3B) microstructures. Swaging closed the majority of porosity remaining in the as-sintered materials. The pores that remained were now smaller and less continuous. For the sake of clarity, FIG. 3A shows the PM6013-Mn—Sn sample as-sintered only and FIG. 3B comparatively shows the PM6013-Mn—Sn sample after sintering and as-swaged. FIGS. 3C-3F then show images of the sintered and swaged microstructures of PM6013-Mn (FIG. 3C), PM6013-Mn—Sn (FIG. 3D), PM6013 (FIG. 3E), and PM6013-Sn (FIG. 3F).

From FIGS. 3B-3F above, it can be seen that swaging was carried out on all powder metal 6013 variants. The qualitative observations are that all alloy formulations swaged well and there was no external cracking or tearing. Moreover, swaging had the effect of homogenizing the microstructures. All microstructures were dominated by white α-aluminum grains, with no evidence suggesting that the secondary intergranular phase had coarsened as a result of the heat applied during hot swaging. A minor fraction of residual porosity remained in all microstructures, consistent with swaged density measurements. Residual porosity was observed to be mainly intergranular in nature.

As in industrial extrusion operations, the grains were elongated in the direction of swaging, when viewed longitudinally. Evidence of metal flow is also present when the edges of the microstructure are viewed, as would be expected from a hot deformation operation.

To further characterize the differences between the "as-sintered" and "as-swaged" samples, as-swaged densities were collected for each formulation and compared to the as-sintered densities (with the average sintered density of each formulation also being seen in Table 5 above). These are shown in Table 6, below and again are expressed as percentages of theoretical density for the particular formulation.

TABLE 6

| Alloy Sample | Average Sintered Density (%) | Averaged Swaged Density (%) |
|---|---|---|
| PM6013-Mn | 91.1 | 99.1 |
| PM6013-Mn—Sn | 90.0 | 99.1 |
| PM6013 | 96.3 | 99.5 |
| PM6013-Sn | 98.4 | 99.4 |

From Table 6 above, it can be seen that swaging improved the density of all powder metal alloy compositions swaged, including the Al-0.6Mn containing samples that did not exhibit densification upon sintering. Swaged samples made with the Al-0.6Mn powder metal (as opposed to pure aluminum plus elemental magnesium) were also slightly longer due to the closure of greater amounts of porosity. Among the four variants of powder metal swaged, there were no significant differences observed in the swaging responses of the alloys. All of the averaged swaged densities exceeded 99% of theoretical density, with the two samples made from pure aluminum being slightly closer to theoretical density than those the two samples made from Al-0.6Mn which is perhaps due in part to the higher starting density pre-swaging.

Because the sintered densities of PM6013 and PM6013-Sn were substantially higher, the differences between their pre- and post-swaged microstructures were less marked. However, each alloy experienced a measurable decrease in the amount of residual porosity present such that all materials were >99% of full theoretical density after swaging. Specifically, PM6013 and PM6013-Sn exhibited swaged densities of 99.5% and 99.4% of theoretical respectively. In comparison, those of PM6013-Mn and PM6013-Mn—Sn were both slightly lower at 99.1%. The marginally improved values measured for PM6013 and PM6013-Sn were attributed to their higher sintered densities (see Table 5), and concomitantly, the fact that there was significantly less residual porosity to eliminate.

Since wrought 6013 is a heat treatable alloy, the effects of T6 and T8 processes on PM6013 variants were also investigated. Both commence with a solutionization stage wherein the core objective is to dissolve precipitate-forming elements into solid solution. Establishing an appropriate temperature for this step is important and is frequently investigated using a differential scanning calorimeter (DSC). DSC tests provide data on the melting behavior of an alloy that can thereby direct research into an appropriate range of solutionizing temperatures.

Accordingly, melting behavior of swaged specimens were assessed using a Netzsch 404 F1 differential scanning calorimeter. Temperature and sensitivity calibrations were carried out prior to testing. All tests were carried out under a conditioned atmosphere, with flowing high-purity nitrogen gas at 50 ml/min. Circular samples were machined from swaged rods (4 mm in diameter by 2 mm in thickness). Samples were heated at a rate of 20° C./minute to 700° C., then cooled at the same rate to ambient temperature.

Figure 4A:
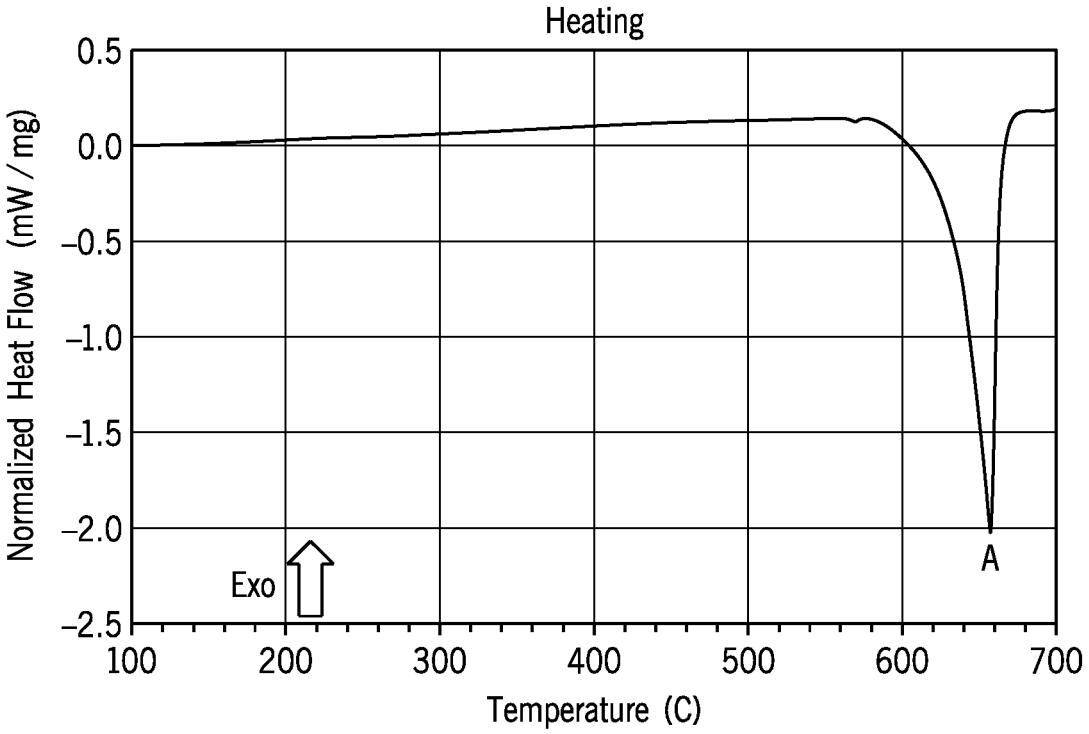
Figure 4B:
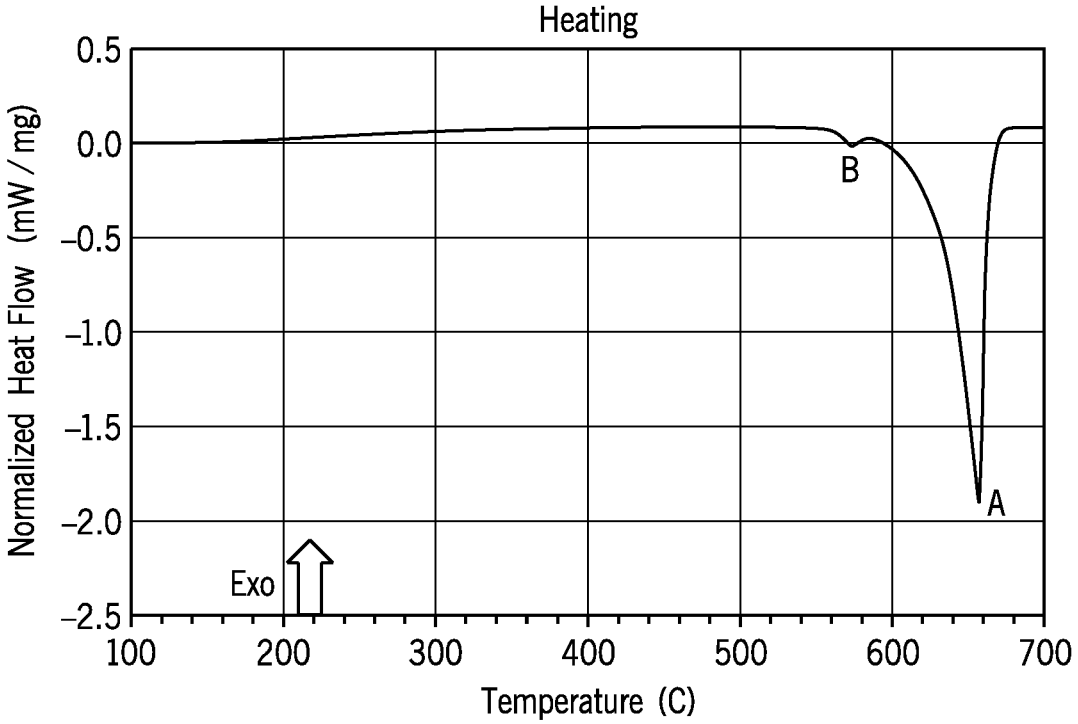
Figure 4C:
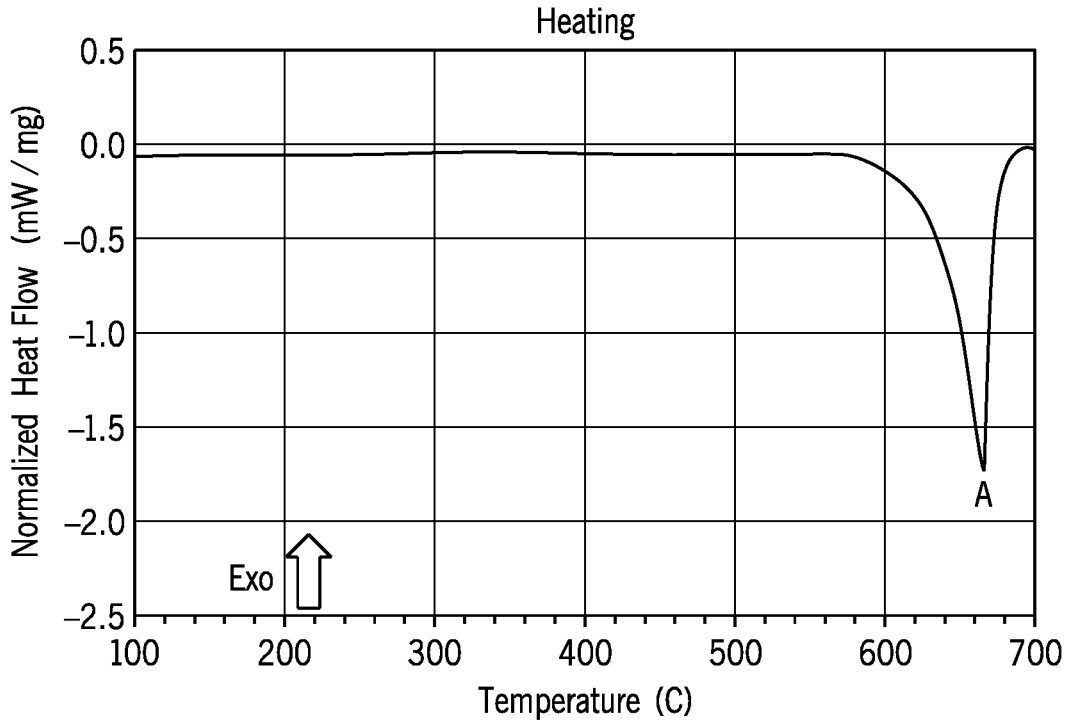
Figure 4D:
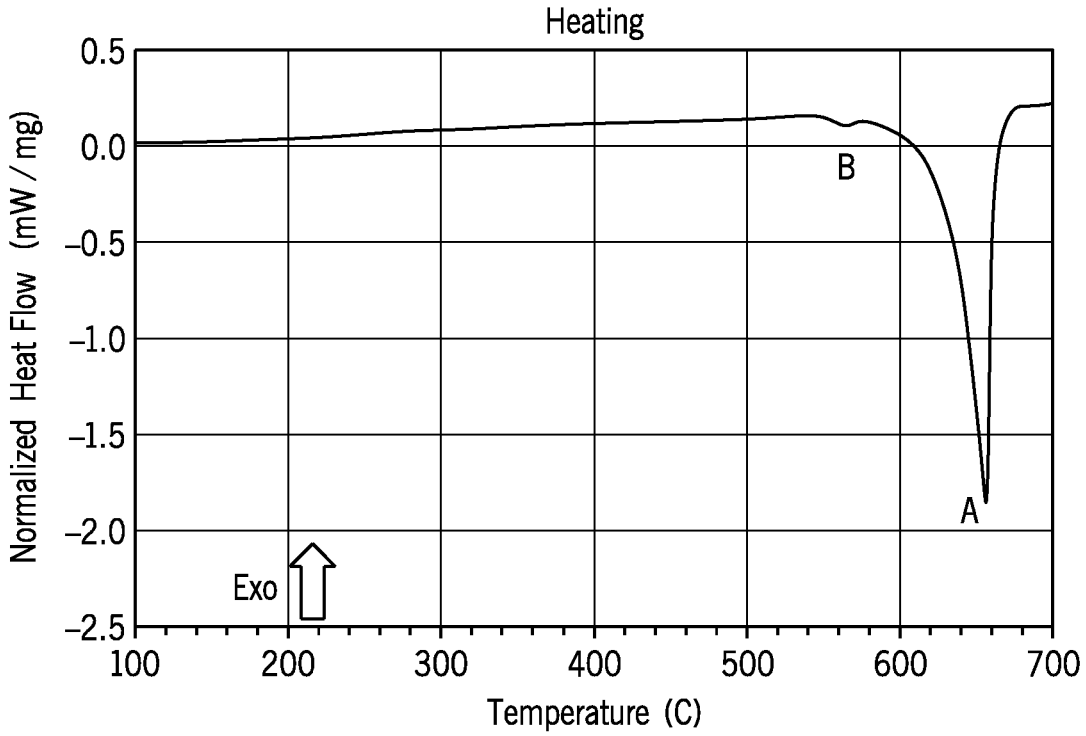

With reference being made to FIGS. 4A-4D, differential scanning calorimetry data in the form of heat flux traces is provided for the samples made from the 6013 powder metal variants over a range of 100° C. to 700° C. and under conditioned atmosphere. As indicated above, FIG. 4A is for PM6013-Mn, FIG. 4B is for PM6013-Mn—Sn, FIG. 4C is for PM6013, and FIG. 4D is for PM6013-Sn.

The "A" and "B" indicators on these figures indicate melting events at the particular temperature indicated. It can be seen that there are a pair of observed melting events for PM6013-Mn—Sn and PM6013-Sn, but only a single melting event for PM6013-Mn and PM6013. All plots show a principal melting event, labelled "A". The magnitude of the peak was relatively consistent across the alloys and had an onset of ~580° C. This event would have corresponded to bulk melting of the alloy as the temperature advanced through the semi-solid regime. Heat traces for alloys that contained tin, FIGS. 4B and 4D, contained a smaller secondary event (peak B) that occurred between ~540° C. and 580° C. It is postulated that this indicated the incipient melting of a phase containing tin. Heat traces from FIGS. 4A and 4C also demonstrated a minor fluctuation around the same location as peak "B". This likely indicates incipient melting in these alloys as well, however, the appreciably larger magnitude of peak "B" in traces from FIGS. 4B and 4D indicate that tin intensified the effect.

The solutionizing temperature itself needs to be above the solvus, but generally not so high that partial melting occurs. The typical solutionizing temperature of wrought 6013 is 570° C. This was below the onset of bulk melting but at the central trough of event "B". Hence, the same temperature could not be arbitrarily applied to the powder metal systems because it could invoke liquid formation and thereby lessen the concentrations of alloying elements dissolved into solid solution. Accordingly, experimentation with a series of solutionization temperatures was needed above and below peak B. Solutionization trials at 540° C., 560° C., and 580° C. were selected for this purpose.

Two post-swage heat treatments were considered—T6 and T8. For the T6 condition, swaged rods were solutionized in air at 560° C. for 2 hours (Lindberg box furnace), water quenched, and then aged at 190° C. (Heratherm mechanical convection oven). To achieve the T8 condition, samples were subjected to the same solutionize/quench process but were then cold worked to achieve an average reduction in thickness of 11%, and then aged at 190° C.

Figure 5A:
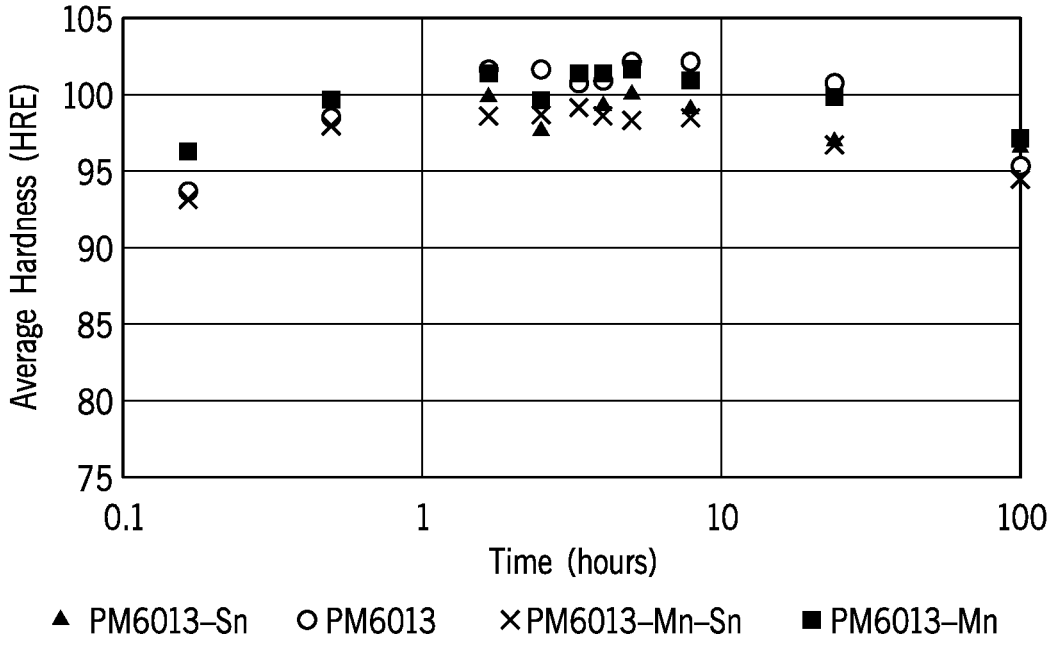
FIGS. 5A-5C are T6 aging data for 6013 powder metal variants in which the samples were sintered, hot swaged, and then solutionized at 540° C.
Figure 5B:
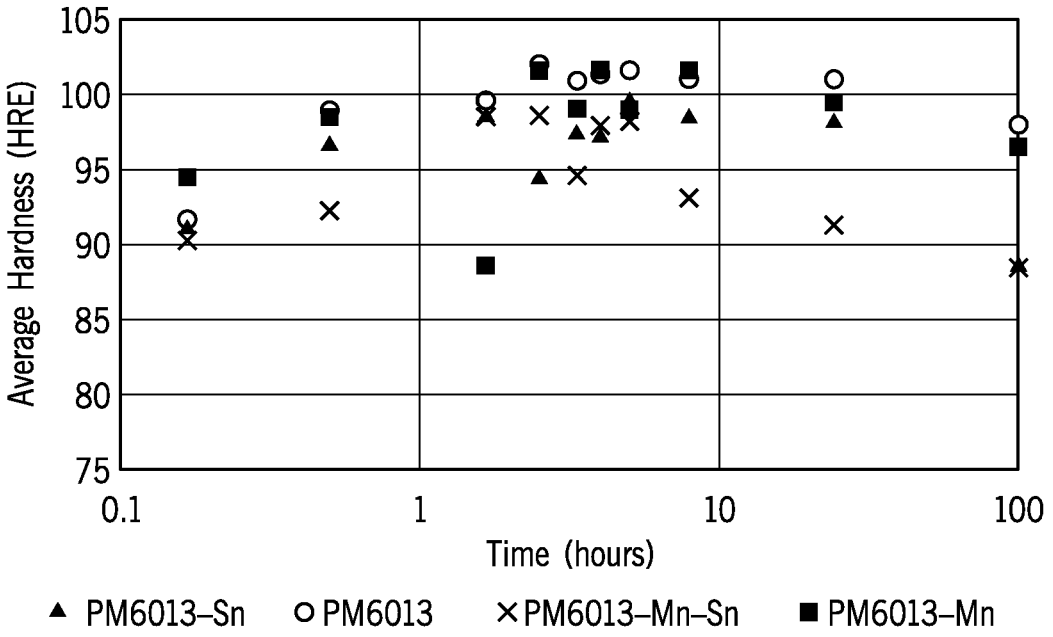
Figure 5C:
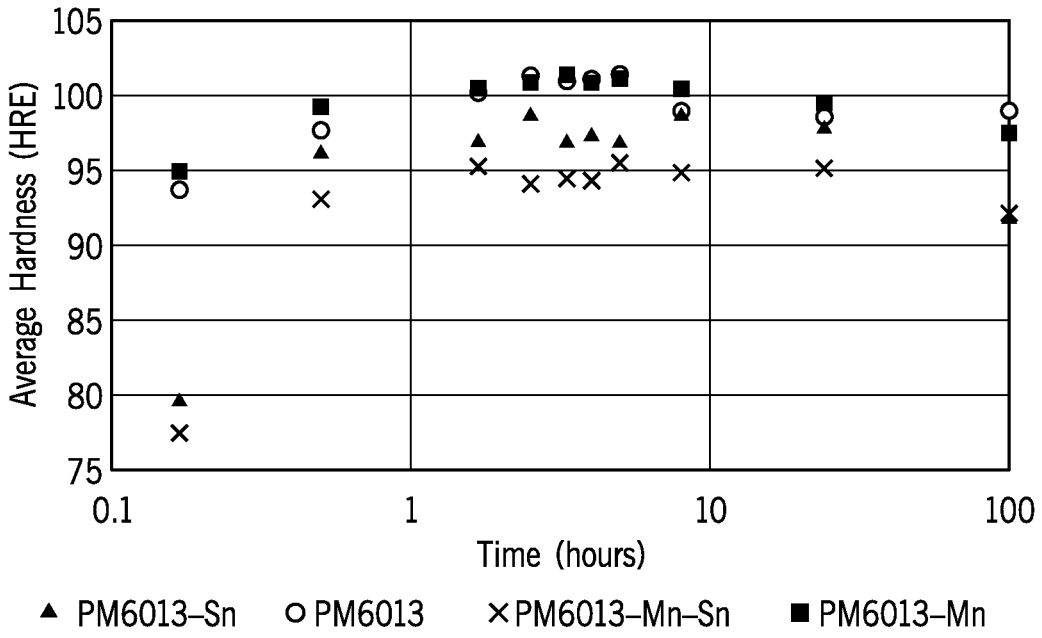

Again, T6 aging curves were developed using the solutionizing temperatures identified through DSC assessments and are found in FIG. 5A for a 540° C. solutionizing temperature, in FIG. 5B for a 560° C. solutionizing temperature, and in FIG. 5C for a 580° C. solutionizing temperature. All curves showed hardness increasing to a peak at approximately 5 hours of artificial aging. Across all alloys, 580° C. consistently produced the lowest hardness readings, suggesting a microstructure in which fewer precipitates formed. This indicates that the solutionizing temperature was excessive. There was little to separate 540° C. and 560° C. aging curves. The 560° C. aging curves demonstrated less consistency amongst the hardness readings, when compared with curves constructed at 540° C. However, the use of 560° C. as a solutionizing temperature did produce the highest hardness readings across alloys during the construction of the aging curve. For the sake of convenience and clarity, peak hardness in FIG. 5B (T6 at 560° C. solutionizing temperature) was 102 HRE for PM6013-Mn, 98HRE for PM6013-Mn—Sn, 102 HRE for PM6013, and 100 HRE for PM6013-Sn.

With these results, an effective T6 heat treatment cycle for all variants was solutionizing at 560° C. followed by water quenching and aging at 190° C. for 5 hours. These heat treatment parameters were used for the remainder of the investigation.

Figure 6A:
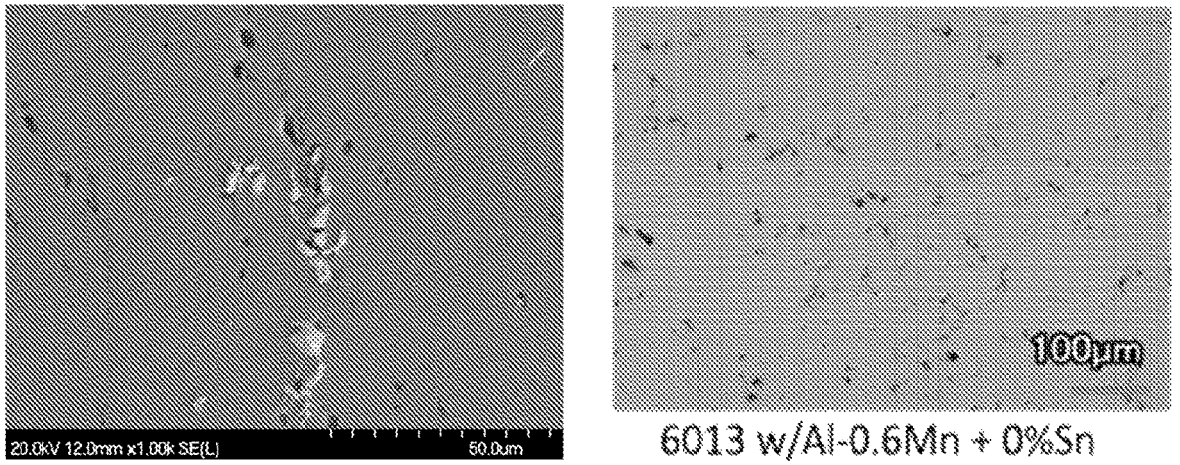
FIG. 6A-6D each shows SEM images of microstructures of PM6013 variants processed through a sinter-swage-T6 sequence including PM6013-Mn in FIG. 6A, PM6013-Mn—Sn in FIG. 6B, PM6013 in FIG. 6C, and PM6013-Sn in FIG. 6D.
Figure 6B:
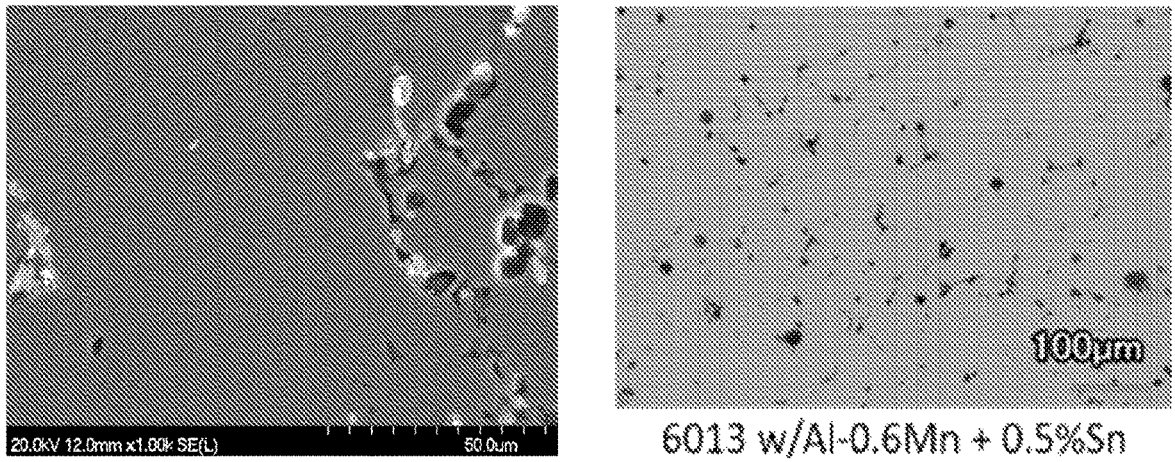
Figure 6C:
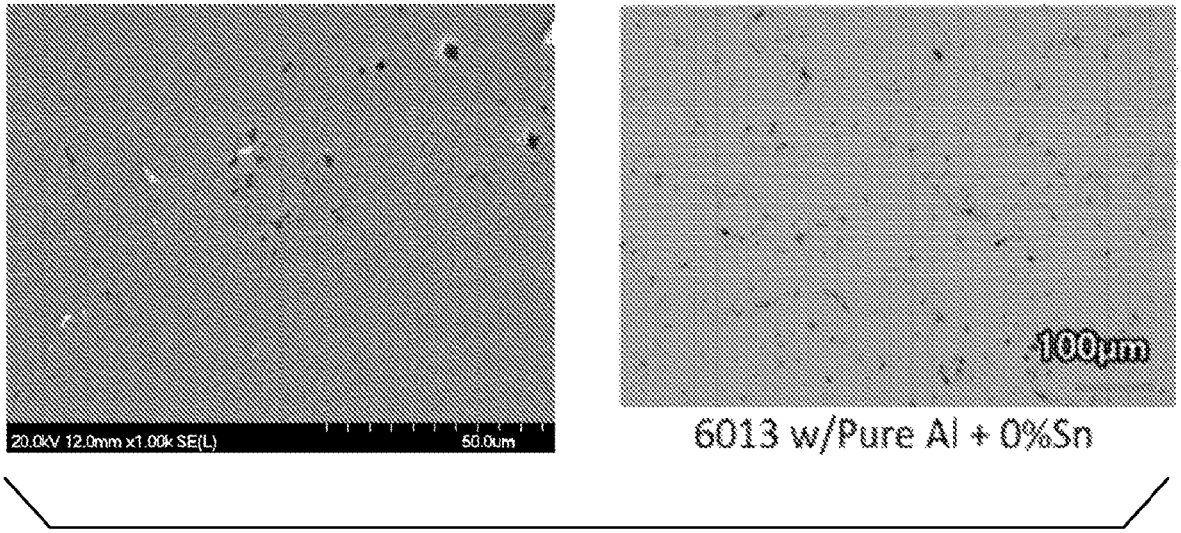
Figure 6D:
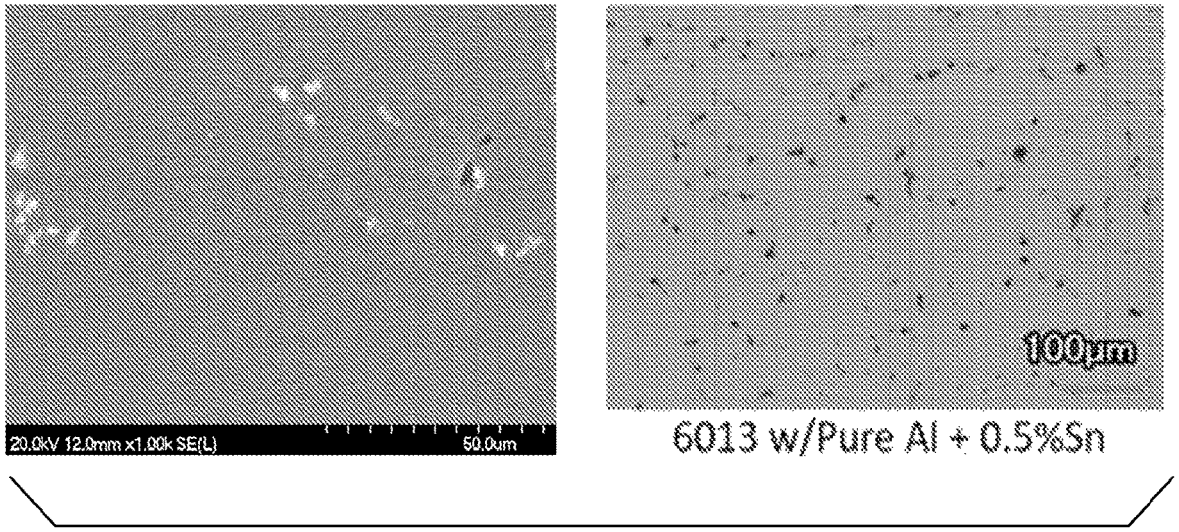
Figure 7A:
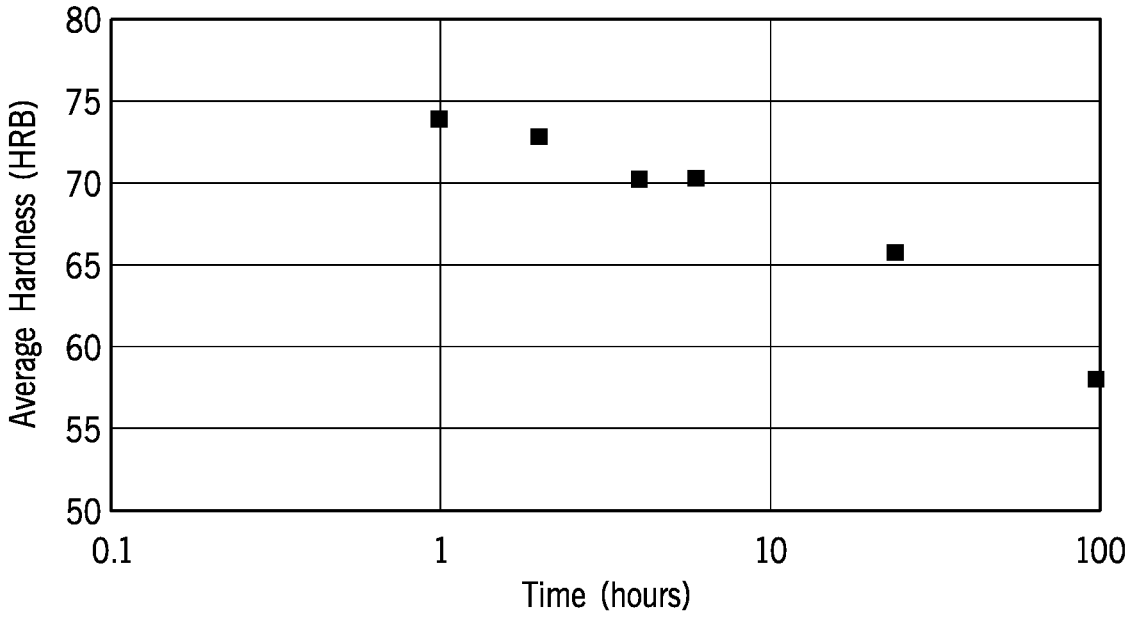
FIGS. 7A-7D are T8 aging data for the powder metal 6013 variants in which the samples were sintered, hot swaged, solutionized at 560° C., water quenched, cold worked, and then aged at 190° C. for the times indicated.
Figure 7B:
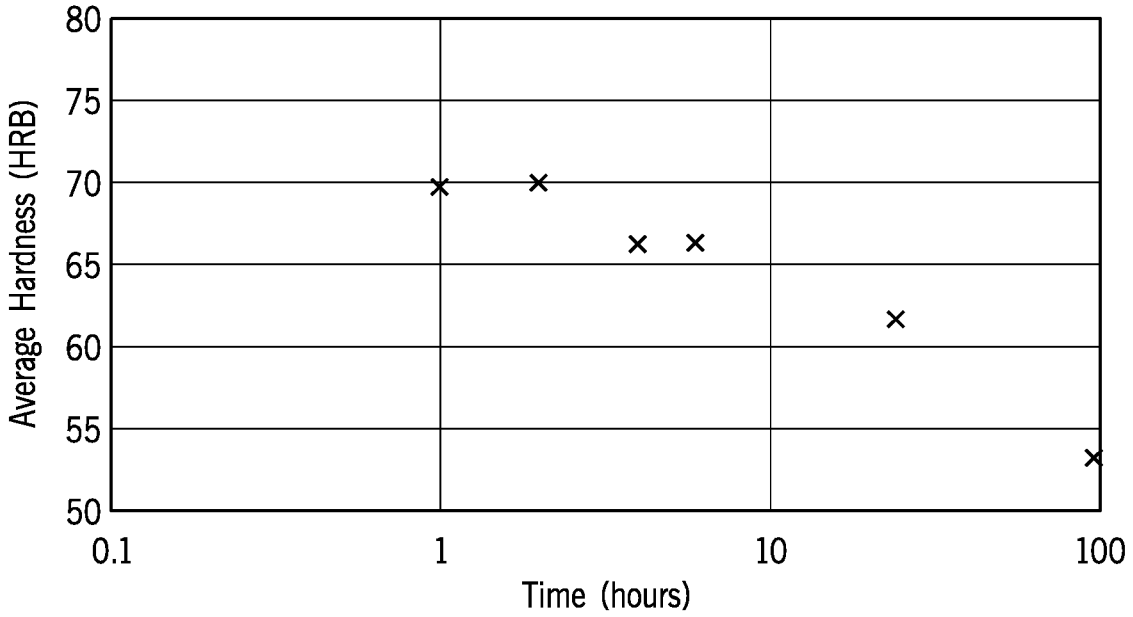
Figure 7C:
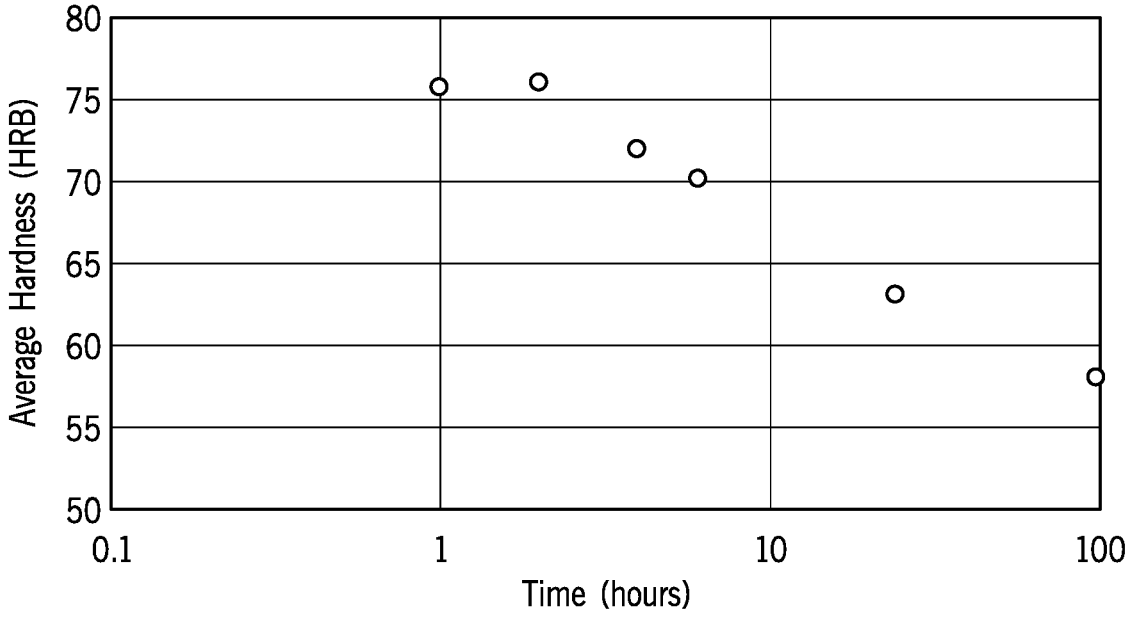
Figure 7D:
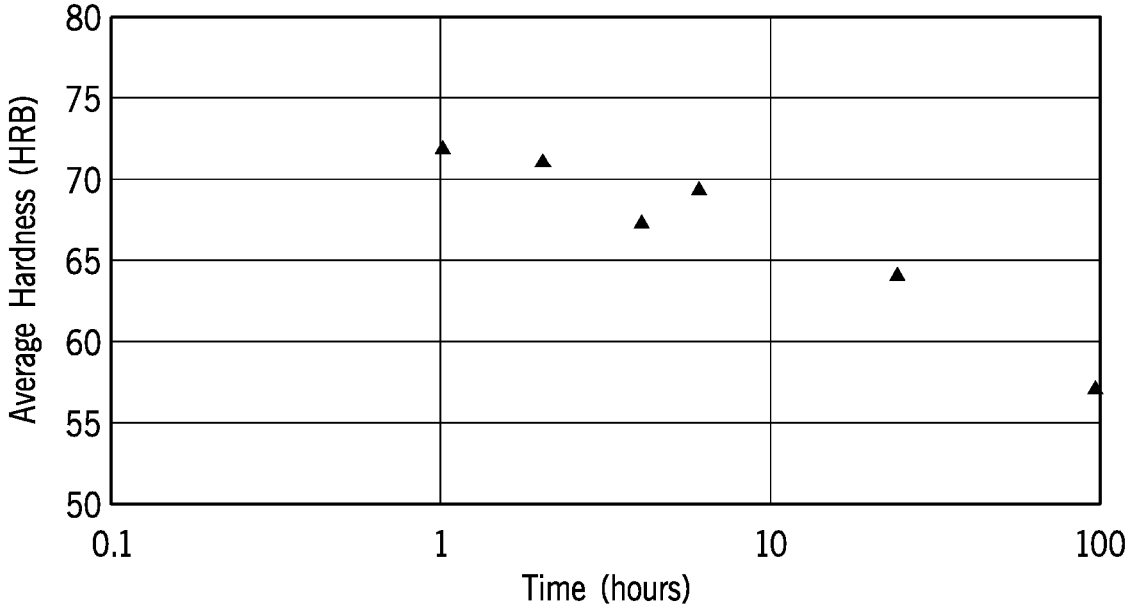

SEM images of samples in the T6 condition are shown in FIGS. 6A-6D. Minor fractions of residual porosity were noted in all cases, as were secondary intergranular constituents. In PM6013-Mn (FIG. 6A), the intergranular feature was light grey, relatively coarse, and, in some instances, also fractured. The latter would have been instilled during hot swaging as cracks within this feature were not observed in as-sintered micrographs FIG. 2A. EDS analyses indicated that it was primarily aluminum with elevated concentrations of manganese (25 wt %) and silicon (10 wt %). A similar phase prevailed within PM6013-Mn—Sn (FIG. 6B), and it too showed evidence of fracture. A secondary intergranular feature was also observed in the alloy. This was brighter than the Mn-containing feature (left images) and was confirmed to be enriched in tin through EDS. As PM6013 did not contain manganese or tin, neither of the aforementioned intergranular features were observed in its microstructure in FIG. 6C. Here, the secondary feature was finer and distributed somewhat more uniformly throughout the microstructure. EDS indicated that it was principally aluminum with elevated, yet varying, concentrations of silicon (4-7 wt %), magnesium (1-2 wt %), and copper (1-4 wt %). In FIG. 6D for PM6013-Sn, a tandem of intergranular features was once again observed. One was similar to that noted in PM6013 but now contained a minor (~1 wt %) concentration of tin. The second was brighter and contained elevated concentrations of tin (47 wt %) and magnesium (22 wt %) with a balance of aluminum. No evidence of cracking was noted in any of the intergranular features within PM6013 or PM-6013-Sn.

An assessment of the T8 aging response was then completed. Data on hardness as a function of aging time are shown in FIGS. 7A-7D for samples of the PM6013-Mn, PM6031-Mn—Sn, PM6013, and PM6013-Sn variants, respectively, that were sintered, hot swaged, solutionized at 560° C., water quenched, cold worked, and then aged at 190° C. for the times indicated. All alloys were quite comparable in this regard as the peak hardness was similar (70-76 HRB) in each instance. Generally, hardness also declined steadily with aging times beyond the first duration considered (1 hour). This behavior indicates that the peak of the curve most likely was missed during the aging experiments. However, the difference between the true peak values and those insinuated by the data was likely minimal, as all curves exhibited a relatively shallow slope at the early stages. For the purposes of this study, 1 hour was adopted as aging time needed to achieve peak hardness in the T8 process. From FIGS. 5A-5C, samples that underwent T6 treatment demonstrated peak hardness values of 65-76 HRB (i.e., 98-101 HRE). Hence, the peak values recorded in T8 samples were rather similar to those achieved through T6 processing.

Figure 8A:
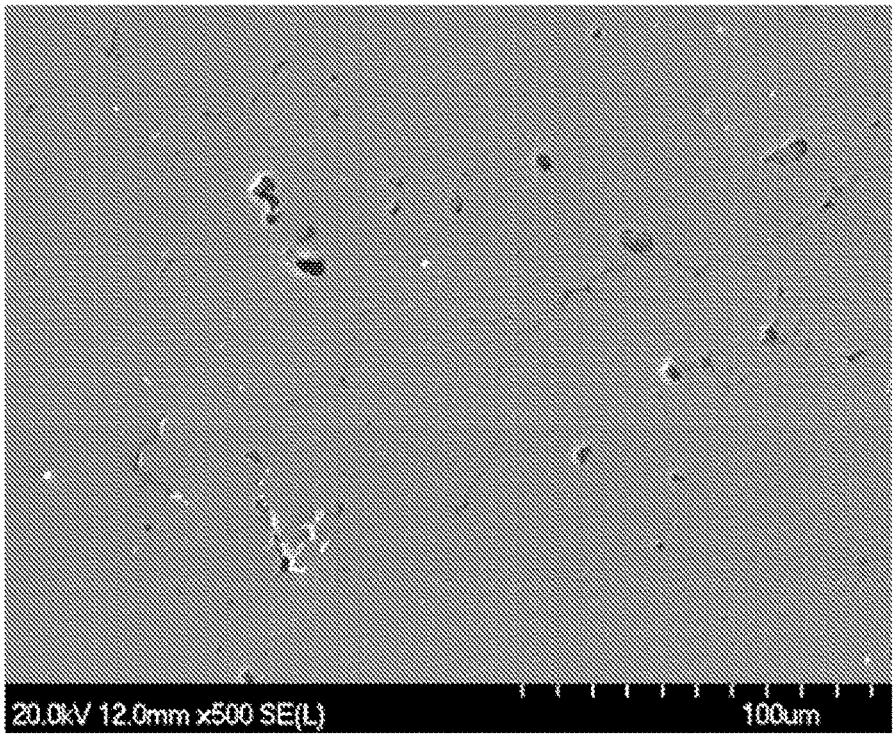
FIGS. 8A-8D are microstructures of PM6013 variants processed through a sinter-swage-T8 sequence including PM6013-Mn in FIG. 8A, PM6013-Mn—Sn in FIG. 8B, PM6013 in FIG. 8C, and PM6013-Sn in FIG. 8D.
Figure 8B:
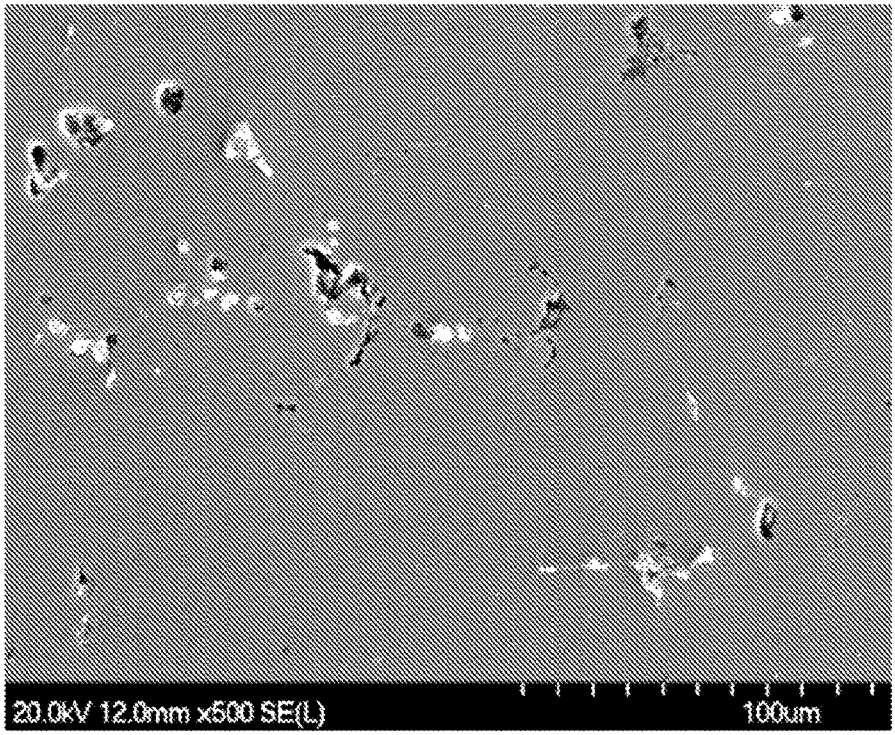
Figure 8C:
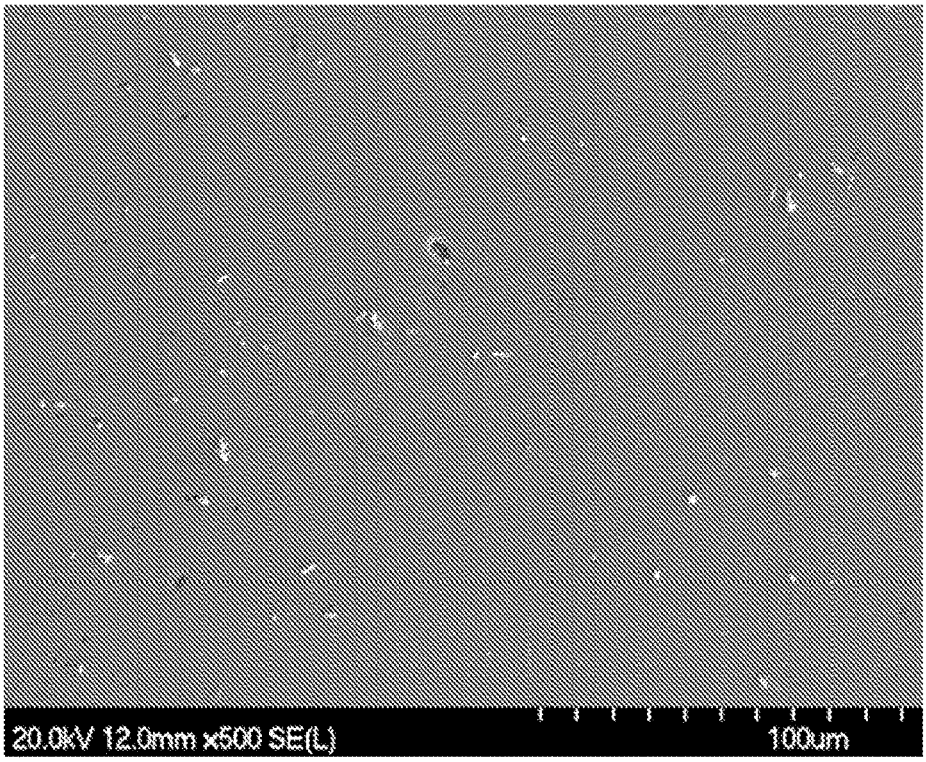
Figure 8D:
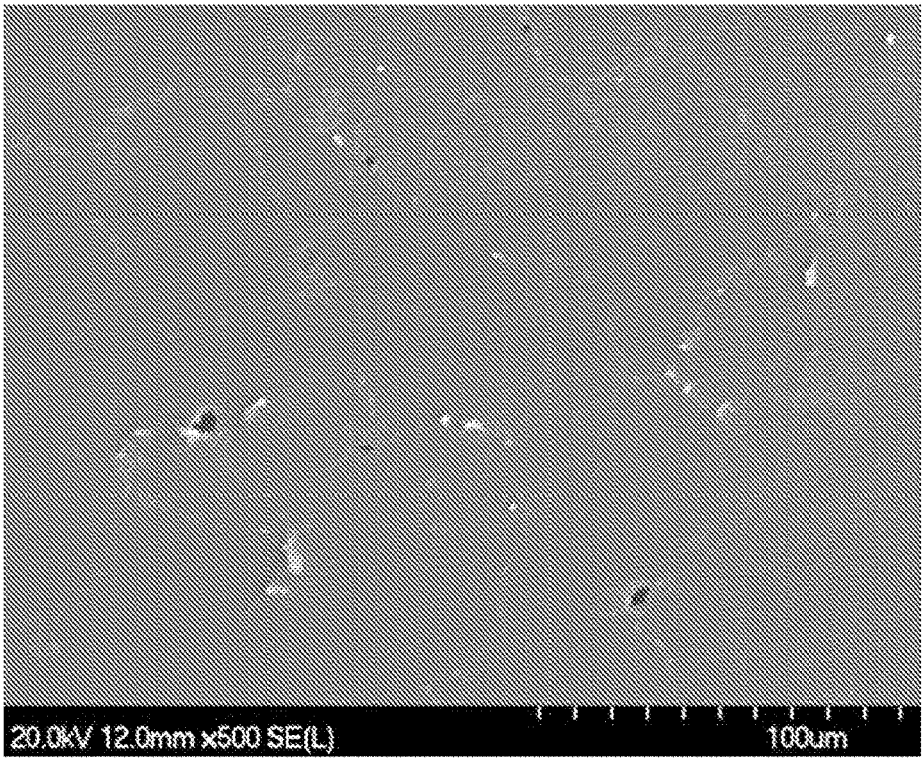

SEM images were obtained for all samples in the T8 condition and are shown in FIGS. 8A-8D with PM6013-Mn being shown in FIG. 8A, PM6013-Mn—Sn being shown in FIG. 8B, PM6013 being shown in FIG. 8C, and PM6013-Sn being shown in FIG. 8D. In each case, the T8 microstructure was remarkably similar to its T6 counterpart (FIGS. 6A-6D). The only difference noted was with PM6013-Mn. For PM6013-Mn, cracking was no longer limited to the boundaries of the intergranular feature but now extended throughout the microstructure as sporadic fractures several hundred microns in length. This was ascribed to the cold working stage of the T8 process.

With heat treatment parameters established, the focus of the study shifted to an assessment of the mechanical properties of each alloy system in the T6 and T8 tempers, including the effect of swaging. Mechanical testing included the measurement of hardness, tensile properties and bending fatigue performance. Hardness data was acquired using a Wilson Rockwell 2000 tester in Rockwell Hardness E-scale (HRE) and Rockwell Hardness B-scale (HRB). Reported values were taken as the average of four measurements. Tensile properties were assessed in accordance with ASTM Standard E8-M. Swaged rods and Charpy bars were machined into threaded-end tensile specimen and then loaded to fracture with an Instron 5594-200 HVL load frame, equipped with a 50 kN load cell and an Epsilon model 3542 extensometer. The extensometer remained attached to each sample through to failure. Reported tensile properties for T6 and T8 samples were averaged values derived from three and two test samples respectively. Bending fatigue properties were assessed per MPIF Standard 56, through application of a staircase method, under a 3-point loading condition and with a 5 MPa step size. All samples were rectangular (31.7 mm×12.7 mm×9.7 mm) and were tested using an Instron 1332 servo-hydraulic frame equipped with an MTS 642 bend fixture that maintained a 24.7 mm span between the two bottom pins. Loading was applied at 25 Hz (R=0.1) to a runout limit of 106 cycles. The 10%, 50% and 90% survival stress values were then calculated from the resultant data.

Figure 9A:
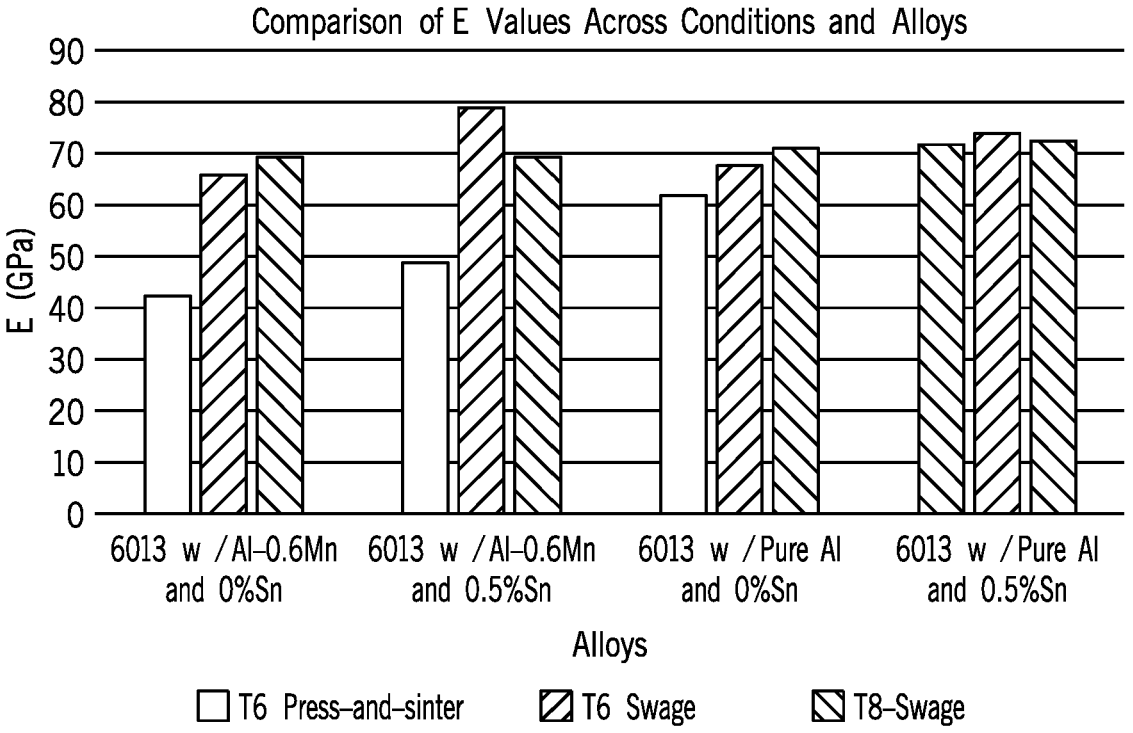
FIGS. 9A-9D are graphs showing tested mechanical properties of the PM6013 variants across various conditions and alloys.
Figure 9B:
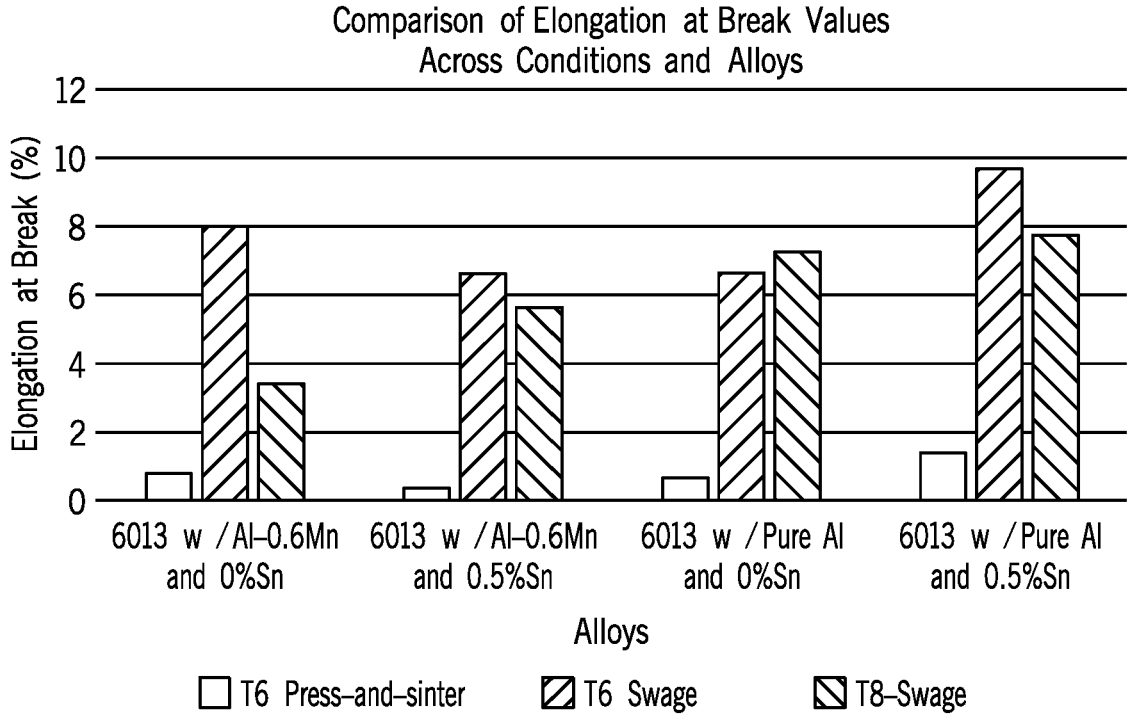
Figure 9C:
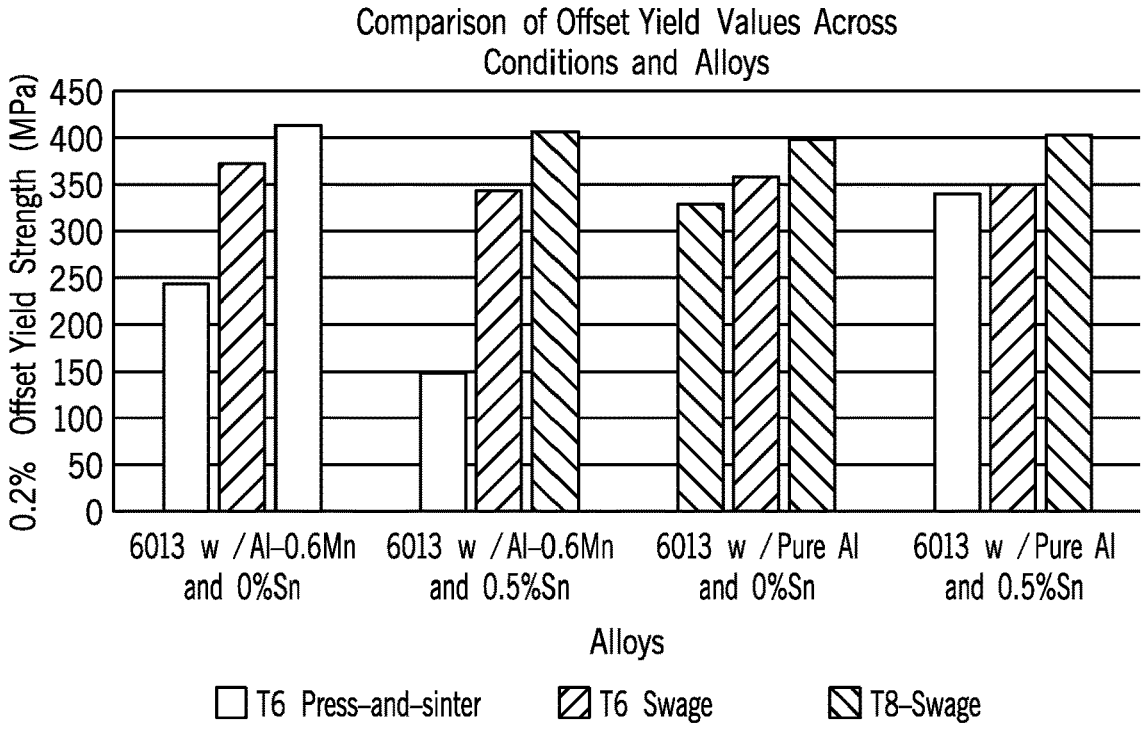
Figure 9D:
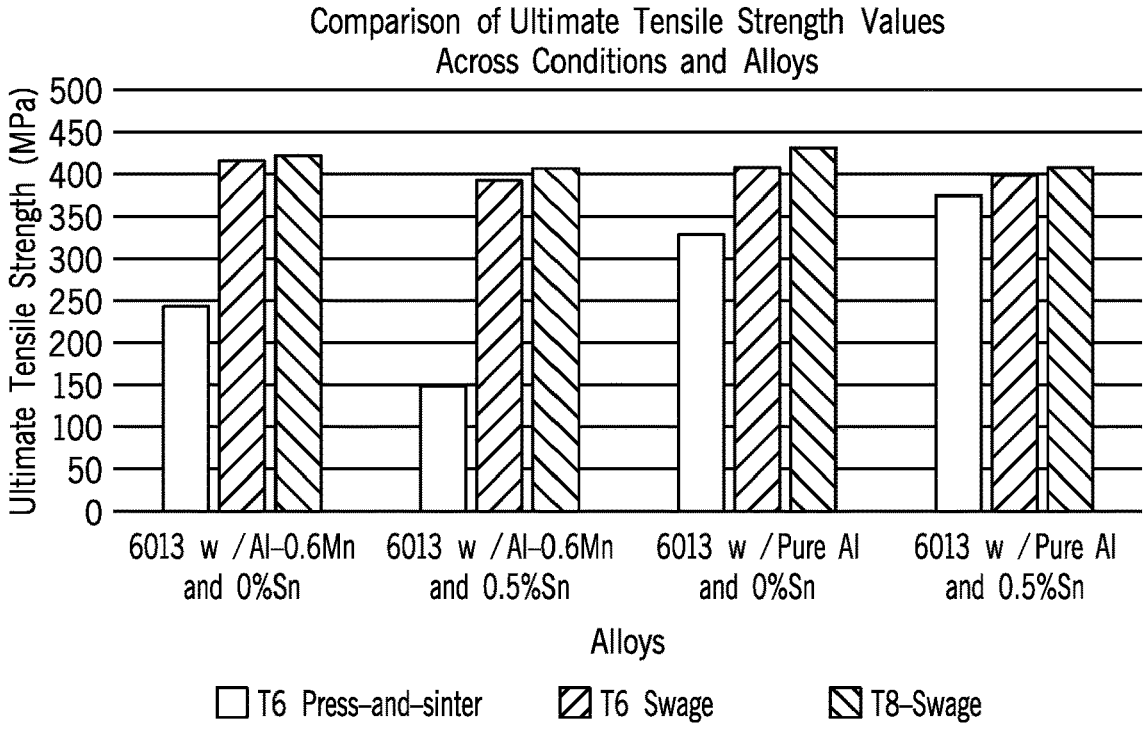

The tensile properties T6 press-and-sintered (i.e., as sintered), T6 swaged, and T8 swaged parts were obtained. This data follows in the tables and discussion below and is also graphically summarized in FIGS. 9A-9D, which show the comparisons of the data for various measured properties (FIG. 9A: Young's Modulus; FIG. 9B: Elongation at Break; FIG. 9C: Offset Yield; and FIG. 9D UTS) across various conditions and compositions.

The tensile properties were measured of the 6013 powder metal variants as processed through a sinter-T6 sequence in which the samples were solutionized for 560° C. at 2 hours, water quenched, aged at 190° C. for 5 hours, and air cooled. These tensile properties can be found in Table 7 below, which includes wrought 6013 aluminum alloy samples for the sake of comparison.

TABLE 7

| Alloy Sample | Processing | E (GPa) | Yield Strength (MPa) | UTS (MPa) | Ductility (%) |
|---|---|---|---|---|---|
| 6013 | Wrought | 70 | 368 | 399 | 11 |
| PM6013-Mn | Press-and-Sinter | 42 ± 5 | 244 ± 3 | 245 ± 3 | 0.8 ± 0.1 |
| PM6013-Mn—Sn | Press-and-Sinter | 48 ± 1 | 149 ± 6 | 150 ± 6 | 0.4 ± 0.1 |
| PM6013 | Press-and-Sinter | 62 ± 1 | 328 ± 4 | 328 ± 4 | 0.7 ± 0.1 |
| PM6013-Sn | Press-and-Sinter | 74 ± 3 | 342 ± 2 | 376 ± 3 | 1.4 ± 0.1 |

From the table above, it can be seen that the press-and-sinter samples made from the 6013 powder metal variants (in particular, PM6013-Sn) can have mechanical properties very similar or nearly equivalent to those of wrought 6013 aluminum alloy samples. However, it can also be seen for that the as-sintered samples—without further swaging—made from Al-0.6Mn (that is, PM6013-Mn and PM6013-Mn—Sn) had relatively poor mechanical performance. Accordingly, all powder metal systems under-performed relative to the wrought counterpart, but the differences were most acute for those that contained pre-alloyed manganese. These materials exhibited exceptionally low values for all properties as a direct result of the heightened levels of residual porosity present in them (Table 5, above). PM6013 and PM6013-Sn, in contrast, performed better in terms of stiffness and yield strength, as these particular properties were within ~10% of the typical wrought values. The UTS of PM6013 was appreciably lower than wrought but was improved in PM6013-Sn. Press-and-sinter samples produced an average tensile ductility approximately 13 times lower than typical wrought values. This stark difference may be attributed to the presence of residual porosity in all the powder metal systems, which is largely absent from the wrought alloy. Overall, PM6013-Sn exhibited the most desirable T6 tensile properties confirming the beneficial role of tin.

With the addition of a swaging step to the processing sequence, the performance gap between wrought 6013 in Table 7 and all powder metal variants, shown in Table 8 below, narrowed dramatically. For the sake of ease of comparison, the as-sintered data from Table 7 is copied below and identified as "Press- and Sinter."

TABLE 8

| Alloy Sample | Condition | E (GPa) | Yield Strength (MPa) | UTS (MPa) | Ductility (%) |
|---|---|---|---|---|---|
| PM6013-Mn | Swage | 65.5 ± 1.3 | 373 ± 2 | 417 ± 2 | 7.9 ± 0.1 |
| | Press-and-Sinter | 42.2 ± 4.9 | 244 ± 3 | 245 ± 3 | 0.8 ± 0.1 |
| PM6013-Mn—Sn | Swage | 78.7 ± 11.2 | 345 ± 1 | 391 ± 1 | 6.6 ± 0.3 |
| | Press-and-Sinter | 48.4 ± 0.5 | 149 ± 6 | 150 ± 6 | 0.4 ± 0.1 |
| PM6013 | Swage | 67.4 ± 3.7 | 358 ± 3 | 410 ± 1 | 6.6 ± 0.7 |
| | Press-and-Sinter | 61.7 ± 0.8 | 328 ± 4 | 328 ± 4 | 0.7 ± 0.1 |
| PM6013-Sn | Swage | 71.8 ± 0.8 | 351 ± 1 | 400 ± 1 | 9.6 ± 0.5 |
| | Press-and-Sinter | 73.6 ± 2.5 | 342 ± 2 | 376 ± 3 | 1.4 ± 0.1 |

In the swaged parts, improvements to the 0.2% offset yield strength and UTS of all powder metal variants were particularly acute, such that these properties were essentially equivalent to the wrought counterpart. Gains in ductility were noted as well, yet none of the powder metal systems achieved net values that matched the wrought threshold.

On average, the swaged-T6 powder metal samples demonstrated an approximately 9-fold increase in ductility over those which had been processed by sinter-T6 with no swaging.

Hot swaging reduced the levels of residual porosity in all powder metal materials but was unable to eliminate it entirely. This effect would have underpinned the remarkable gains achieved, but also the inability of powder metal systems to maintain a ductility that matched wrought 6013 as the remaining pores would have served as sites for crack initiation thereby limiting net ductility. Hot swaging would have contributed to the improvement in ductility through the disruption of the semi-continuous oxide network that is typically present in sintered products as well. During sintering, the alumina shell present on the surface of raw aluminum powders reacts with magnesium to form spinel crystallites ($MgAl_2O_3$). This brittle ceramic remains throughout the sintered product and decreases tensile ductility. Hot forging has been observed to disrupt the spinel network, and thereby improve tensile ductility. It is reasonable to posit that the same mechanism engaged here. It is also notable that the fractured intergranular phases observed in FIGS. 6A and 6B did not appear to degrade ductility significantly. Other tensile properties remained relatively consistent across all four alloys. Collectively, PM6013-Sn was identified as the powder metal alloy that offered the best overall combination of properties; highest ductility coupled with yield strength, UTS, and stiffness values that were competitive with wrought.

Data on PM6013 variants processed through a sinter-swage-T8 sequence (560° C. solutionizing temperature for two hours, followed by water quench, sizing and aging at 190° C.) are shown in Table 9 below.

TABLE 9

| Alloy Sample | E (GPa) | Yield Strength (MPa) | UTS (MPa) | Ductility (%) |
|---|---|---|---|---|
| PM6013-Mn | 69 ± 1 | 415 ± 1 | 422 ± 1 | 3.4 ± 0.6 |
| PM6013-Mn—Sn | 69 ± 2 | 408 ± 2 | 409 ± 2 | 5.6 ± 0.1 |
| PM6013 | 71 ± 1 | 399 ± 2 | 431 ± 2 | 7.3 ± 0.1 |
| PM6013-Sn | 72 ± 1 | 404 ± 4 | 409 ± 3 | 7.7 ± 0.3 |

These particular materials demonstrated the highest yield strength and UTS of all sequences considered and there were no significant trends observed with the presence/absence of manganese or tin. The heightened values came at the expense of modest losses in tensile ductility relative to materials subjected to a sinter-swaged-T6 process. The decrease can be attributed, in part, to the cold working stage of the T8 heat treatment, as this would have increased the concentration of dislocations present so as to invoke strain hardening and a concomitant decline in ductility. The nature and distribution of the precipitates should have changed as a result of the T8 treatment and also been a factor of influence. In this sense, cold working can change the rate and degree of hardening that occurs because precipitates can preferentially nucleate on dislocations, thus increasing their concentration within the microstructure. The additional strengthening imparted by this change could have been accompanied by a decrease in ductility. Overall, the lowest ductility was noted in PM6013-Mn. This was presumably underpinned by the aforementioned mechanisms coupled with cracks noted in the microstructure (FIG. 8A).

It is also seen that alloys with pure aluminum in the base aluminum powder were more ductile than those in which the base aluminum powder was pre-alloyed with aluminum (i.e., Al-0.6Mn), those alloy variants with tin were more ductile than those without tin, and that the alloys without tin displayed higher UTS values in comparison with tin.

In summary, the powder metal 6013 systems processed through sinter-swage-T6/T8 sequences performed relatively well in comparison with wrought 6013. In particular, PM6013-Sn most closely approximated properties attained by wrought and outperformed all of the other powder metal alloys with respect to tensile ductility regardless of the processing sequence employed. As such, the final stage of fatigue assessment was focused exclusively on this specific powder metal system.

Finally, data on the fatigue performance of PM6013-Sn are shown in Table 10 for the three processing sequences considered.

TABLE 10

| Processing Sequence | $\sigma_{a,10}$ (MPa) | $\sigma_{a,50}$ (MPa) | $\sigma_{a,90}$ (MPa) |
|---|---|---|---|
| Sinter-T6 | 160 | 150 | 140 |
| Sinter-Swage-T6 | 260 | 252 | 243 |
| Sinter-Swage-T8 | 248 | 215 | 181 |

The sinter-T6 product exhibited the lowest resistance to fatigue loading. Inclusion of a hot swaging step (that is, sinter-swage-T6) led to a 102 MPa (~68%) increase in the median bending fatigue strength. This was significant as hot swaging addresses two factors know to have a negative impact on fatigue—residual porosity and the oxide network present. Considering the former, fatigue generally increases exponentially with density and even a small reduction in the volume fraction of residual porosity can have a significant impact by lowering the number of sites available for crack nucleation and growth. Hence, although the improvement in density of PM6013-Sn as a result of swaging was comparatively small (~1%) the net impact on fatigue would have been decisively positive. For the latter, the disruption of the oxide network through hot swaging, as discussed above, contributed to the improvement in fatigue resistance in the same manner as it improved tensile ductility. The dispersion of fine particles of the brittle spinel phase throughout the material lowers sites for crack nucleation and provides additional strengthening through the engagement of a mechanism analogous to the strengthening present in a metal matrix composite.

Specimens from the sinter-swage-T8 process also maintained an appreciable improvement over the sinter-T6 material (~43% increase) for the same reasons noted above. However, they were also inferior (~15%) to sinter-swage-T6 products. The reduced ductility of the T8 sample observed in the tensile properties likely contributed to these results.

From the above description and disclosure, the following can be appreciated. First, pre-alloying the base aluminum powder with manganese degraded compaction and sintering behavior. Second, all powder metal alloys based on 6013 responded well to hot swaging as they achieved near theoretical densities (>99% of full theoretical) with a visual absence of defects. Third, the addition of hot swaging to the processing sequence manifested meaningful increases in yield strength, UTS, ductility, and fatigue performance for materials in the T6 and T8 tempers. Finally, sinter-swage-T6 PM6013-Sn was the best system overall in terms of its response to powder metal processing and comparability in mechanical properties to wrought 6013-T6. While other variations might certainly be employed, this processing route and composition hold the most promise for a powder metal comparable to wrought 6013.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A powder metal composition providing a powder metal material to be compacted, sintered, and heat treated to be comparable to wrought 6013 aluminum alloy, the powder metal composition comprising:

an aluminum base powder metal;

an aluminum-silicon powder metal;

an aluminum-copper powder metal; and an elemental magnesium powder metal;

wherein a weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to 1.2 wt % of the powder metal composition;

wherein the powder metal composition has a flow rate of between 2.0 and 3.0 g/s.

2. The powder metal composition of claim 1, wherein the aluminum base powder metal is pure aluminum with no effective alloying elements pre-alloyed in the aluminum base powder metal.

3. The powder metal composition of claim 2, wherein the powder metal composition further comprises an elemental tin powder metal and a weight percent of tin in the powder metal composition is between 0.2 wt % and 1.0 wt % of the powder metal composition.

4. The powder metal composition of claim 3, wherein:

the weight percent of silicon in the powder metal composition is more narrowly in a range of 0.7 to 0.9 wt % of the powder metal composition;

the weight percent of copper in the powder metal composition is more narrowly in a range of 0.8 to 1.0 wt % of the powder metal composition;

the weight percent of magnesium in the powder metal composition is more narrowly in a range of 0.9 to 1.1 wt % of the powder metal composition; and the weight percent of tin in the powder metal composition is more narrowly in a range of 0.4 to 0.6 wt % of the powder metal composition; and wherein a balance of the powder metal composition is aluminum with only non-effective trace additions of any other alloying elements.

5. The powder metal composition of claim 4, wherein:

the weight percent of silicon in the powder metal composition is 0.8 wt % of the powder metal composition;

the weight percent of copper in the powder metal composition is 0.9 wt % of the powder metal composition;

the weight percent of magnesium in the powder metal composition is 1.0 wt % of the powder metal composition; and the weight percent of tin in the powder metal composition is 0.5 wt % of the powder metal composition.

6. The powder metal composition of claim 1, wherein the aluminum base powder metal is an aluminum powder metal pre-alloyed with manganese to provide a weight percent of manganese in the powder metal composition is in a range of 0.2 to 1.2 wt % of the powder metal composition.

7. The powder metal composition of claim 6, wherein the weight percent of manganese in the powder metal composition is more narrowly in a range of 0.4 to 0.6 wt % of the powder metal composition.

8. The powder metal composition of claim 7, wherein the weight percent of manganese in the powder metal composition is 0.5 wt % of the powder metal composition.

9. The powder metal composition of claim 6, wherein the powder metal composition further comprises an elemental tin powder and a weight percent of tin in the powder metal composition is in a range of 0.2 wt % to 1.0 wt % of the powder metal composition.

10. The powder metal composition of claim 1, wherein the powder metal composition further comprises an elemental tin powder and a weight percent of tin in the powder metal composition is in a range of 0.2 wt % to 1.0 wt % of the powder metal composition.

11. The powder metal composition of claim 1, wherein the aluminum-silicon powder metal is an Al-12Si master alloy powder metal and wherein the aluminum-copper powder metal is an Al-50Cu master alloy powder metal.

12. The powder metal composition of claim 1, wherein the powder metal composition further includes a lubricant and wherein the weight percentages of the alloying elements are exclusive of the weight of the lubricant as the lubricant is configured to be burned off during sintering of the powder metal composition.

13. The powder metal composition of claim 1, further comprising a ceramic powder addition to provide a metal matrix composite upon sintering, wherein the ceramic powder addition is less than 15 volume percent of the powder metal, and wherein the weight of the ceramic powder addition is not taken into account in calculating the weight percentages of the alloying elements.

14. A powder metal composition providing a powder metal material to be compacted, sintered, and heat treated to be comparable to wrought 6013 aluminum alloy, the powder metal composition comprising:

an aluminum base powder metal;

an aluminum-silicon powder metal;

an aluminum-copper powder metal; and an elemental magnesium powder metal;

wherein a weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to 1.2 wt % of the powder metal composition;

the powder metal composition further comprising a ceramic powder addition to provide a metal matrix composite upon sintering, wherein the ceramic powder addition is less than 15 volume percent of the powder metal, wherein the weight of the ceramic powder addition is not taken into account in calculating the weight percentages of the alloying elements, and wherein the ceramic powder addition is an aluminum nitride having a specific surface area of less than or equal to 2.0 $m^2/g$ and has a particle size distribution of D 10% of between 0.4 and 1.4 μm, D 50% of between 6 and 10 μm, and D 90% of between 17 and 35 μm.

15. A powder metal composition providing a powder metal material to be compacted, sintered, and heat treated to be comparable to wrought 6013 aluminum alloy, the powder metal composition comprising:

an aluminum base powder metal;

an aluminum-silicon powder metal;

an aluminum-copper powder metal; and an elemental magnesium powder metal;

wherein a weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to 1.2 wt % of the powder metal composition;

the powder metal composition further comprising a ceramic powder addition to provide a metal matrix composite upon sintering, wherein the ceramic powder addition is less than 15 volume percent of the powder metal, wherein the weight of the ceramic powder addition is not taken into account in calculating the weight percentages of the alloying elements, and wherein the ceramic powder addition is an aluminum nitride having a specific surface of between 1.8 and 3.8 $m^2/g$ and has a particle size distribution of D 10% of between 0.2 and 0.6 μm, D 50% of between 1 and 3 μm, and D 90% of between 5 and 10 μm.

16. The powder metal composition of claim 14, wherein the aluminum nitride has a hexagonal crystal structure and is single phase.

17. A powder metal composition providing a powder metal material to be compacted, sintered, and heat treated to be comparable to wrought 6013 aluminum alloy, the powder metal composition comprising:

an aluminum base powder metal;

an aluminum-silicon powder metal;

an aluminum-copper powder metal; and an elemental magnesium powder metal;

wherein a weight percent of silicon in the powder metal composition is in a range of 0.6 to 1.0 wt % of the powder metal composition, a weight percent of copper in the powder metal composition is in a range of 0.7 to 1.1 wt % of the powder metal composition, and a weight percent of magnesium in the powder metal composition is in a range of 0.8 to 1.2 wt % of the powder metal composition;

the powder metal composition further comprising a ceramic powder addition to provide a metal matrix composite upon sintering, wherein the ceramic powder addition is less than 15 volume percent of the powder metal, wherein the ceramic powder addition is silicon carbide, wherein the silicon carbide is a β-silicon carbide and is in a range of 2 volume percent to 10 volume percent of the powder metal, and wherein the weight of the ceramic powder addition is not taken into account in calculating the weight percentages of the alloying elements.

18. A green compact formed from the powder metal composition of claim 1.

19. A sintered powder metal component formed from the green compact of claim 18.

20. The sintered powder metal component of claim 19, wherein a sintered density of the sintered powder metal component exceeds 95% of theoretical density.

21. The sintered powder metal component of claim 19, wherein the sintered powder metal component, as sintered and subjected to a T6 treatment of solutionizing, water quenching, aging, and air cooling has a Young's modulus of between 61 GPa and 77 GPa, a Yield Strength of between 324 MPa and 344 MPa, and an ultimate tensile strength (UTS) between 324 MPa and 379 MPa.

* * * * *